US005960727A

United States Patent [19]

Miyasako et al.

[11] Patent Number: 5,960,727

[45] Date of Patent: Oct. 5, 1999

[54] EMBROIDERY SEWING MACHINE

[75] Inventors: Masami Miyasako; Kanji Michioku, both of Tokyo, Japan

[73] Assignee: Juki Corporation, Tokyo, Japan

[21] Appl. No.: 09/166,106

[22] Filed: Oct. 2, 1998

[30] Foreign Application Priority Data

Oct. 3, 1997 [JP] Japan ..... 9-271570

[51] Int. Cl.[6] ..... D05B 21/00; D05C 5/02

[52] U.S. Cl. ..... 112/102.5; 112/445; 112/454

[58] Field of Search ..... 112/102.5, 470.06, 112/475.19, 445, 456, 458; 364/470.09, 470.07

[56] References Cited

U.S. PATENT DOCUMENTS 4,341,170 7/1982 Beckerman et al. ..... 112/445

4,499,838 2/1985 Voza ..... 112/456 X 5,803,000 9/1998 Morita ..... 112/102.5

*Primary Examiner*—Peter Nerbun

*Attorney, Agent, or Firm*—Morgan & Finnegan

[57] ABSTRACT

An embroidery sewing machine is provided with an editing device for editorially combining or joining a plural number of embroidery component patterns into a composite or target embroidery pattern on a display window, which is larger than an embroidering frame for holding a work cloth, and a sewing device for sewing the thus edited composite embroidery pattern onto a work cloth set to the embroidering frame. The editing device has an enlarging function to edit the embroidery component patterns and to display a part of the composite embroidery pattern in an area larger than the display window in a manner that a preset point is set as a reference point on a display area of the display window and the reference point is horizontally and vertically moved. The sewing device has a continuing function to continue the sewing operation of the composite embroidery pattern that is edited in the area larger than that of the display window by use of the enlarging function of the editing device.

3 Claims, 30 Drawing Sheets

EMBROIDERY SEWING MACHINE

BACKGROUND OF THE INVENTION

The present invention relates to a home-use embroidery sewing machine capable of sewing a large composite embroidery pattern on a work cloth.

There is known a sewing method, called a joining embroidering, in which an embroidery pattern that is larger in area than the embroidering frame for holding a work cloth is sewn on a work cloth by use of a home-use embroidery sewing machine, through several sewing operations.

In the joining embroidering, a sewing job or process of sewing the large embroidery pattern follows an editing process. In the editing process, an edit area (display area), which is four times (two times in length and width) as large as the embroidering frame, is set on the screen of a display device. Embroidery component patterns are stored in such a memory as internal memory of the machine or an external memory (e.g., a memory card). An embroidery component pattern or patterns read out of the memory are laid out on the edit area. The work of laying out the patterns is repeated plural number of times to editorially join or combine the layout patterns to compose a target embroidery pattern.

After the editing process is completed, the sewing job starts. Reference positions on the work cloth set to the embroidering frame are stored in advance in a memory. A first region (selected in advance) of the work cloth is set to the embroidering frame. Referring to the reference position data, the embroidery sewing machine sews a first embroidery pattern (or patterns) to the first region of the work cloth within the embroidering frame. Then, the work cloth having the stitches of the first embroidery pattern is detached from the embroidering frame, and a second region of the work cloth is set again to the embroidering frame. The embroidery sewing machine sews a second embroidery pattern (patterns), which is different from the first embroidery pattern already used, onto the second region of the work cloth. Subsequently, the above procedural steps are sequentially repeated to compose, combine or join those preselected embroidery patterns in an editorial manner, whereby a large composite embroidery pattern or a target embroidery pattern is formed.

Thus, the target embroidery pattern large in size is formed by editorially combining, joining or composing plural sets of the embroidery patterns. Each set may comprise one embroidery component pattern within the edit area (four times as large as the embroidering frame). The data representative of the target embroidery pattern is stored in a storing means of the computer system contained in the embroidery sewing machine. The embroidery sewing machine sews the target embroidery pattern onto the work cloth under control of a software implementation of target embroidery pattern sewing, driven by the computer system. An example of the prior art on this technique is U.S. patent application Ser. No. 08/966,070, filed by the Applicant of the present Patent Application.

The embroidery sewing machine by the disclosed technique is capable of handling a target embroidery pattern having the size within the edit area that is four times as large as the embroidering frame, but the embroidery sewing machine needs the assist of eye measurement by the operator in sewing an embroidery pattern larger than the edit area, viz., composing embroidery component patterns into a target embroidery pattern.

Thus, the measurement by the human eyes is essential to the formation of a stitch pattern of the target embroidery by the conventional embroidery sewing machine.

An example of the target embroidery pattern having a plural number of embroidery component patterns is shown in FIG. 1. One rectangular or unit block of a lattice laid over the X-Y coordinates illustrated is equal in size to the embroidering frame. An edit area consists of four unit blocks; the size of the edit area is four times (two times in length and width) as large as the unit block.

In the example of FIG. 1, embroidery component patterns "B" and "C" are within one edit area defined by coordinate points (X0, Y0) and (X1, Y1), and hence can be handled for their sewing by the conventional embroidery sewing machine. Embroidery component patterns "A" and "D" are out of that edit area, and hence cannot be handled by the conventional embroidery sewing machine.

Thus, the conventional embroidery sewing machine cannot sew a target embroidery pattern neatly by joining or combining a plural number of composite embroidery patterns each consisting of preselected embroidery component patterns.

SUMMARY OF THE INVENTION

Accordingly, an object of the present invention is to provide a home-use embroidery sewing machine which can neatly sew a composite embroidery pattern large in size.

To achieve the above object, according to the present invention, there is provided an embroidery sewing machine in which an emboridery pattern is formed on a work cloth, the embroidery sewing machine comprising: an embroidering frame for holding the work cloth; a display window capable of displaying an embroidery pattern in an area larger than an area of the embroidering frame; editing means for editorially composing a plural number of embroidery component patterns displayed on the display window to a composite embroidery pattern, the editing means having an enlarging function to edit the embroidery component patterns and to display a part of the composite embroidery pattern in an area larger than the display window in a manner that a preset point is set as a reference point on a display area of the display window and the reference point is horizontally and vertically moved; and sewing means for sewing the composite embroidery pattern onto the work cloth held by the embroidering frame, the sewing means having a continuing function to continue the sewing operation of the composite embroidery pattern that is edited in the area larger than that of the display window by use of the enlarging function of the editing means.

The embroidering frame is 24 cm high×13 cm wide in size. The display window provides an edit area of 48 cm high×26 cm wide (four times as large as the area of the embroidering frame).

The editing means enables the operator to choose his desired embroidery component pattern or patterns, and to change the positions of the patterns and the angles of the patterns when rotated. The edited patterns may be stored in the form of data into storage means, e.g., an internal or external memory.

The sewing means includes a needle drive mechanism for driving a needle for the needle thread, a hook drive mechanism for driving a bobbin case with a bobbin thread wound thereon, and an X-Y drive mechanism for driving the embroidering frame, and is operated under control of control means.

In the embroidery sewing machine described above, the editing means has an enlarging function to edit the embroidery component patterns and to display a part of the composite embroidery pattern in an area larger than the display window in a manner that a preset point is set as a reference point on a display area of the display window and the reference point is horizontally and vertically moved. Therefore, the embroidery sewing machine allows the operator to edit the embroidery component patterns while viewing a part of the composite embroidery pattern in an area larger than the display window.

Further, the sewing means has a continuing function to continue the sewing operation of the composite embroidery pattern that is edited in the area larger than that of the display window by use of the enlarging function of the editing means. With this feature, the embroidery sewing machine can sew the composite or target embroidery pattern thus edited, in the display area larger than the display window.

Furthermore, a sewable area frame corresponding to the embroidering frame is displayed on the display window, and a sewable-area frame position storing means is further provided which stores movement positions resulting from the movements of the reference points in the sewable area frame.

The embroidery sewing machine above includes a sewable-area frame position storing means for storing movement positions resulting from the movements of the reference points in the sewable area frame. With this feature, in the editing process and the sewing process, the movement positions may be read out from the storing means, and be displayed on the display window.

DESCRIPTION OF THE PREFERRED EMBODIMENTS

The preferred embodiment of an embroidery sewing machine, which is constructed according to the present invention, will be described in detail with reference to the accompanying drawings.

Figure 1:
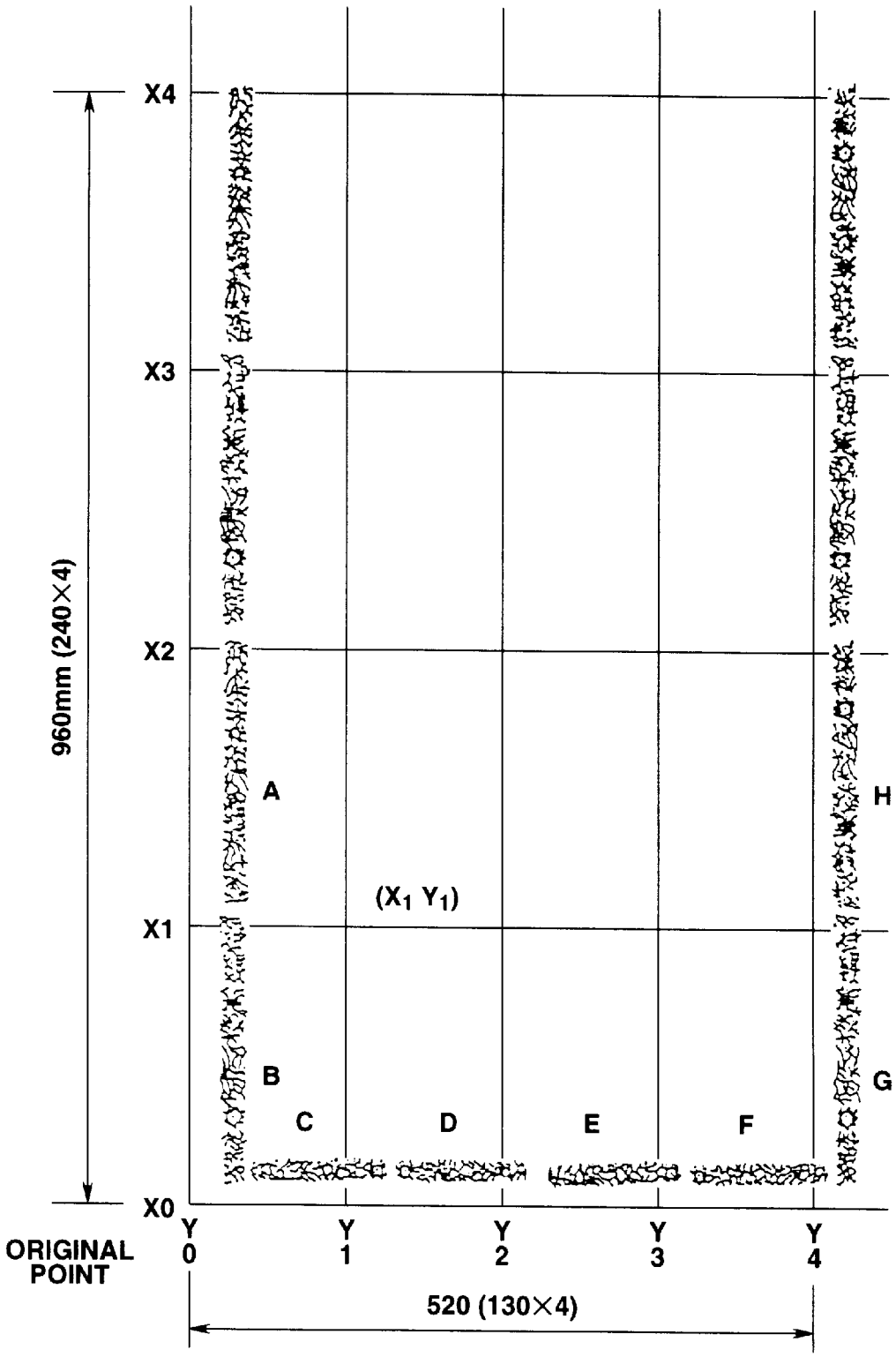
FIG. 1 is a diagram showing an example of a target embroidery pattern having a plural number of embroidery component patterns, which is depicted on an X-Y coordinate system having a lattice pattern laid over.

FIG. 1 is a plan view showing an example of a composite- or target-embroidery editing of an endless pattern, which is laid over a coordinate system. FIGS. 2 through 19 show screens of sewing processing steps.

Figure 20:
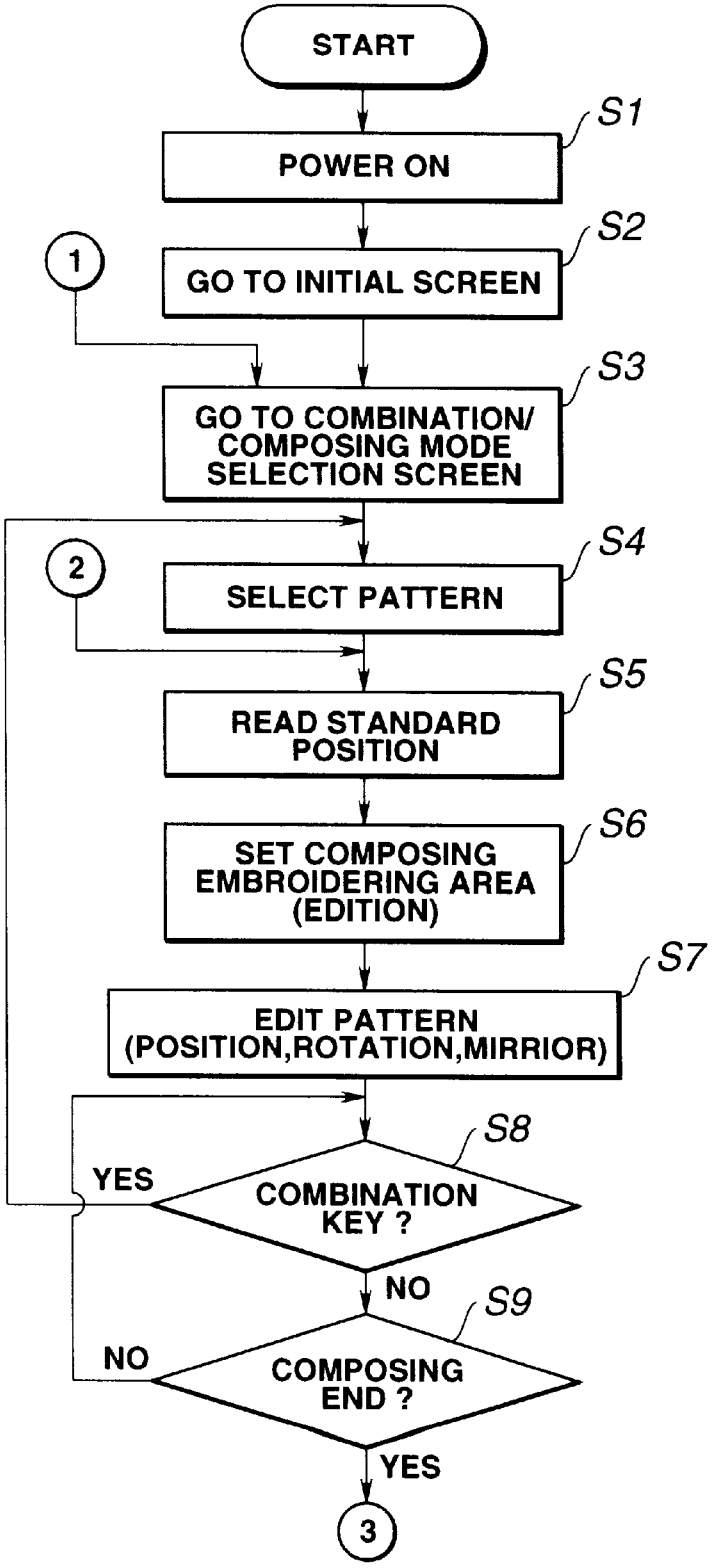
FIG. 20 is a general flow chart showing an editing process for forming a stitch pattern of a composite or target embroidery.
Figure 21:
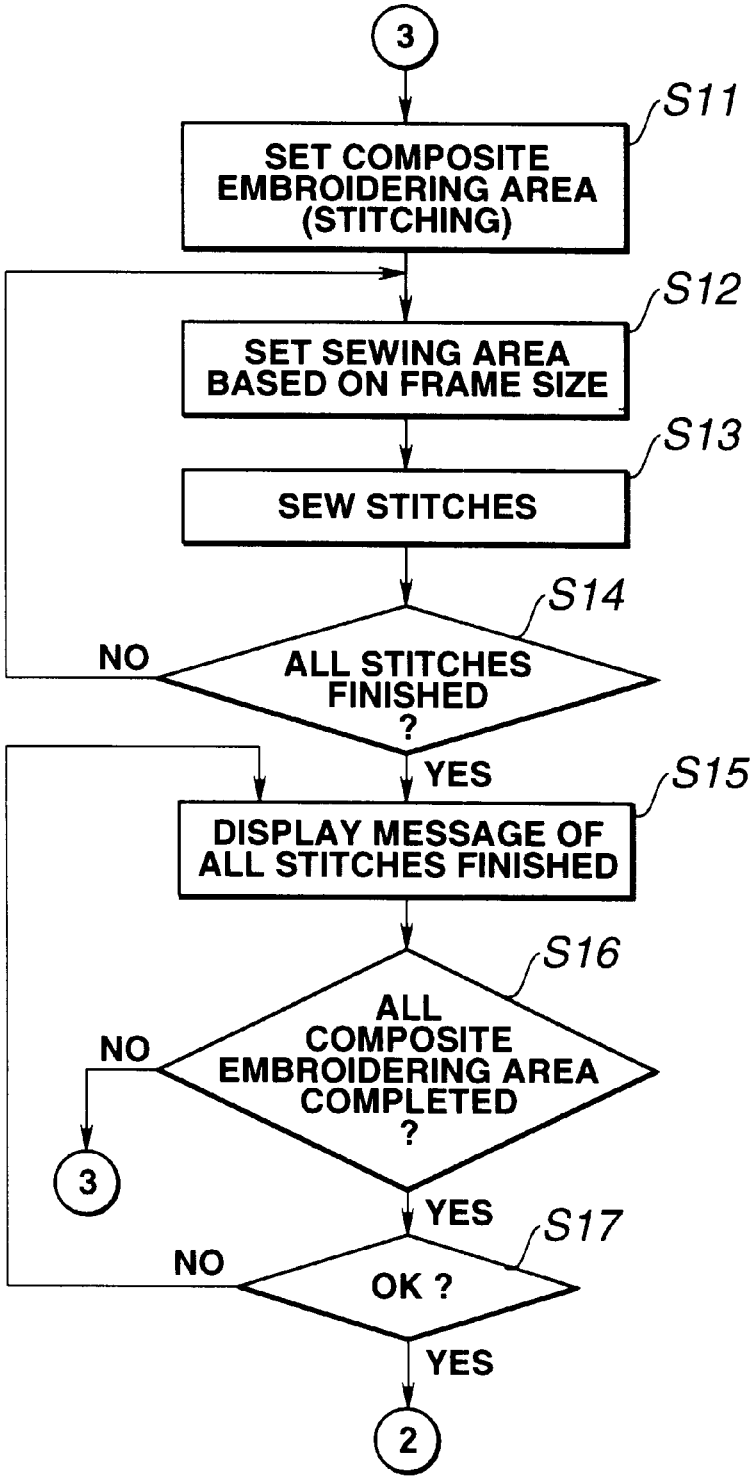
FIG. 21 is a general flow chart showing a sewing process for forming a stitch pattern of a composite or target embroidery.
Figure 22:
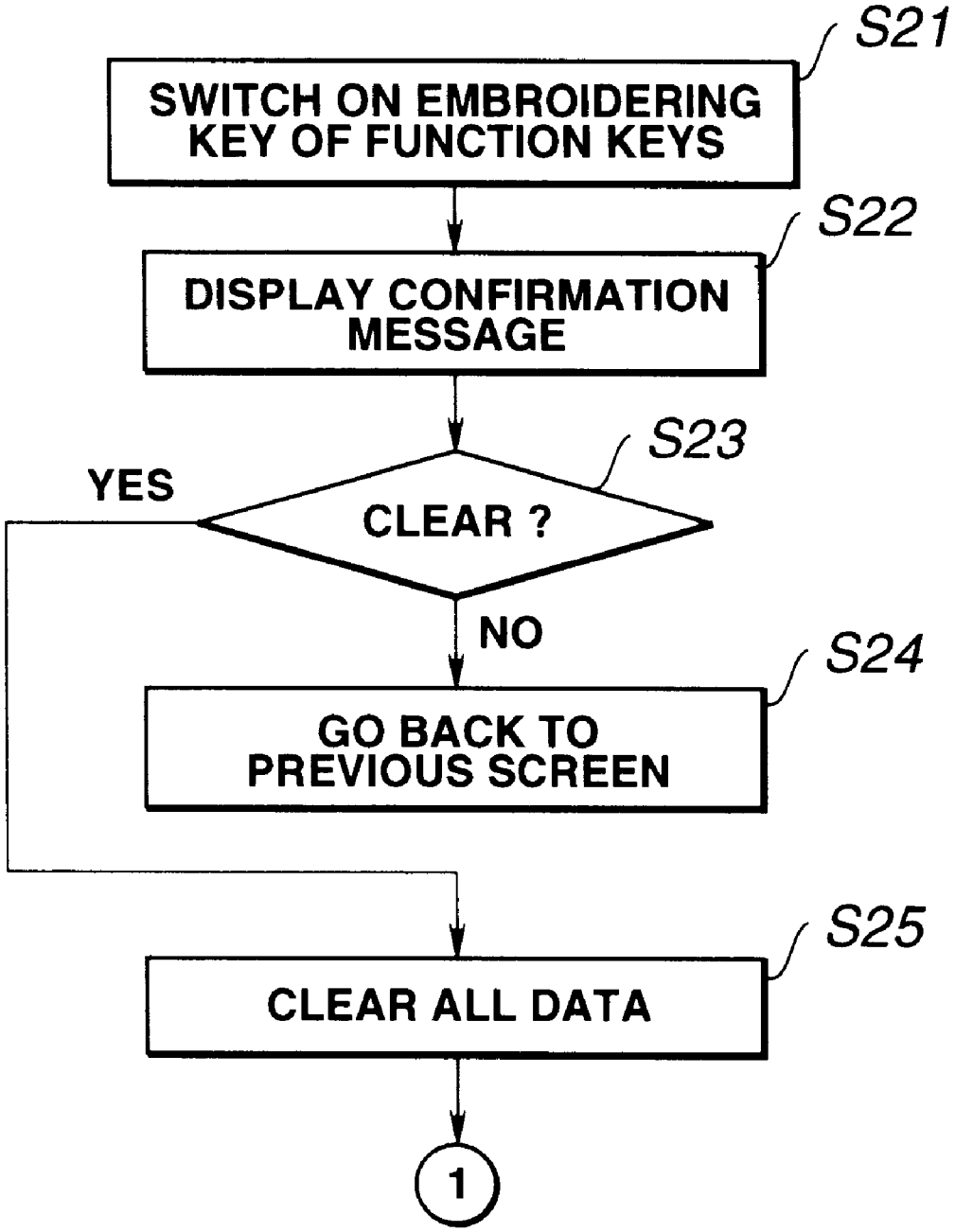
FIG. 22 is a flow chart showing a subroutine (1) in the general flow of FIG. 20.

FIGS. 20 and 21 cooperatively show a general flow chart showing an editing process and a sewing process for forming a stitch pattern of a composite or target embroidery. FIG. 22 is a flow chart showing a subroutine (1) in the general flow of FIG. 20.

Figure 23:
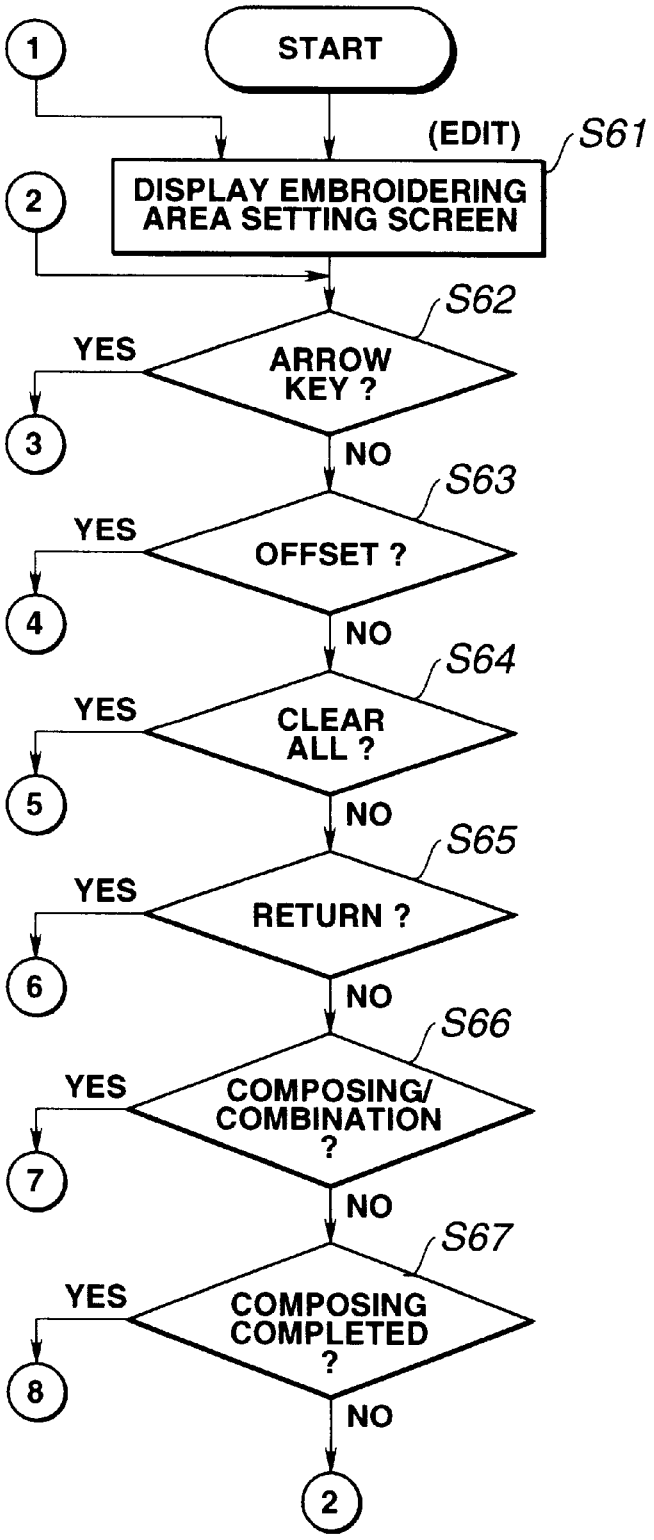
FIG. 23 is a flow chart showing a subroutine of "composite-embroidery area setting (editing)" (step S6) in the general flow chart shown in FIG. 20.

FIG. 23 is a flow chart showing a subroutine of "composite-embroidery area setting (editing)" (step S6) in the general flow chart shown in FIG. 20. FIGS. 24 through 29 are flow charts showing the subroutines (2), (3), (4), (7) and (8) in the general flow of FIG. 23.

Figure 30:
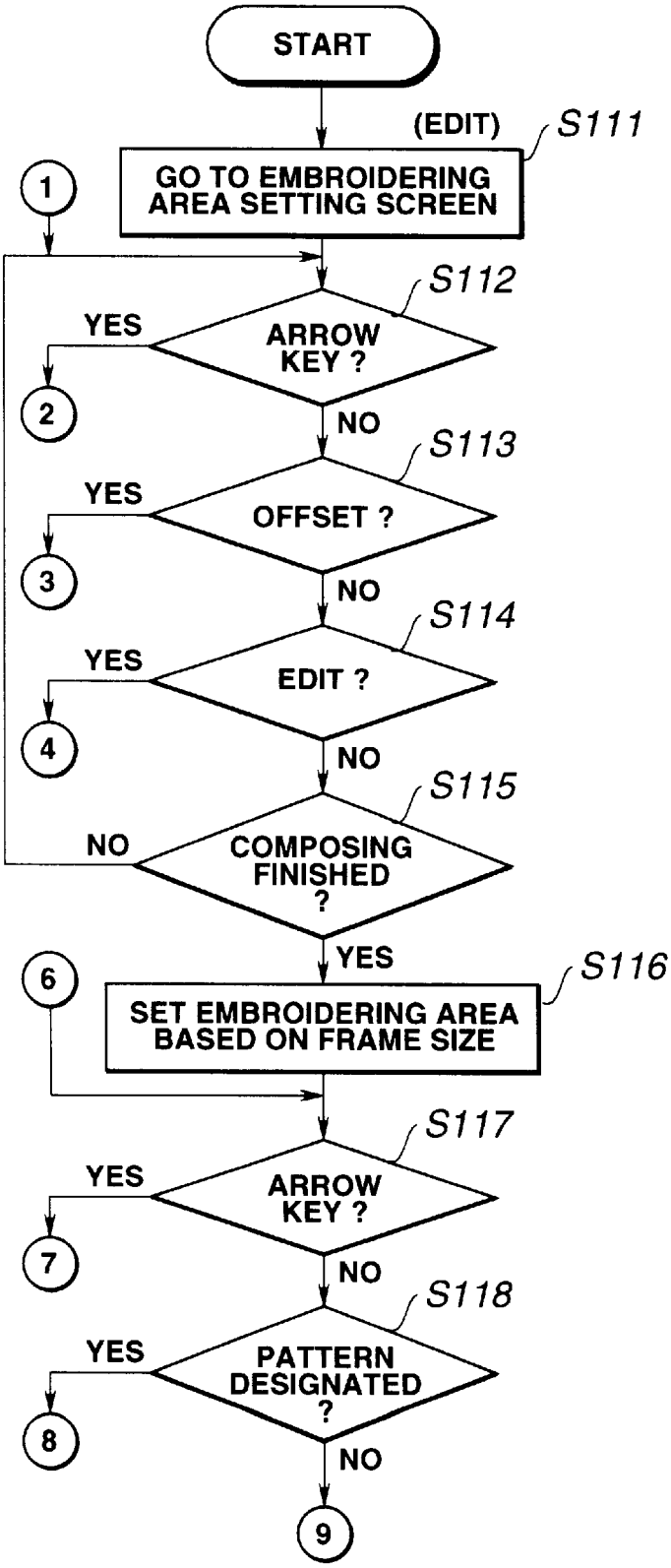
FIG. 30 is a flow chart showing a subroutine of "composite-embroidery area setting (sewing)" (step S11) in the general flow chart shown in FIG. 21.
Figure 31:
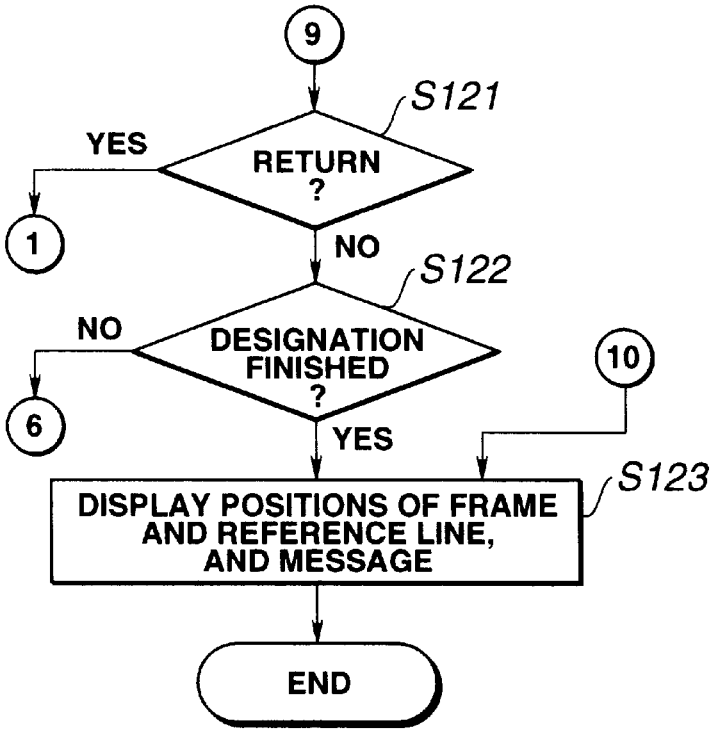
FIG. 31 is a flow chart continued from the FIG. 30 flow chart, both being connected at a process (9)

FIGS. 30 and 31 are flow charts showing a subroutine of "composite-embroidery area setting (sewing)" (step S11) in the general flow chart shown in FIG. 21. FIGS. 32 through 36 show flow charts showing the subroutines (2), (3), (4), (7) and (8) in the general flow of FIG. 30.

Figure 37:
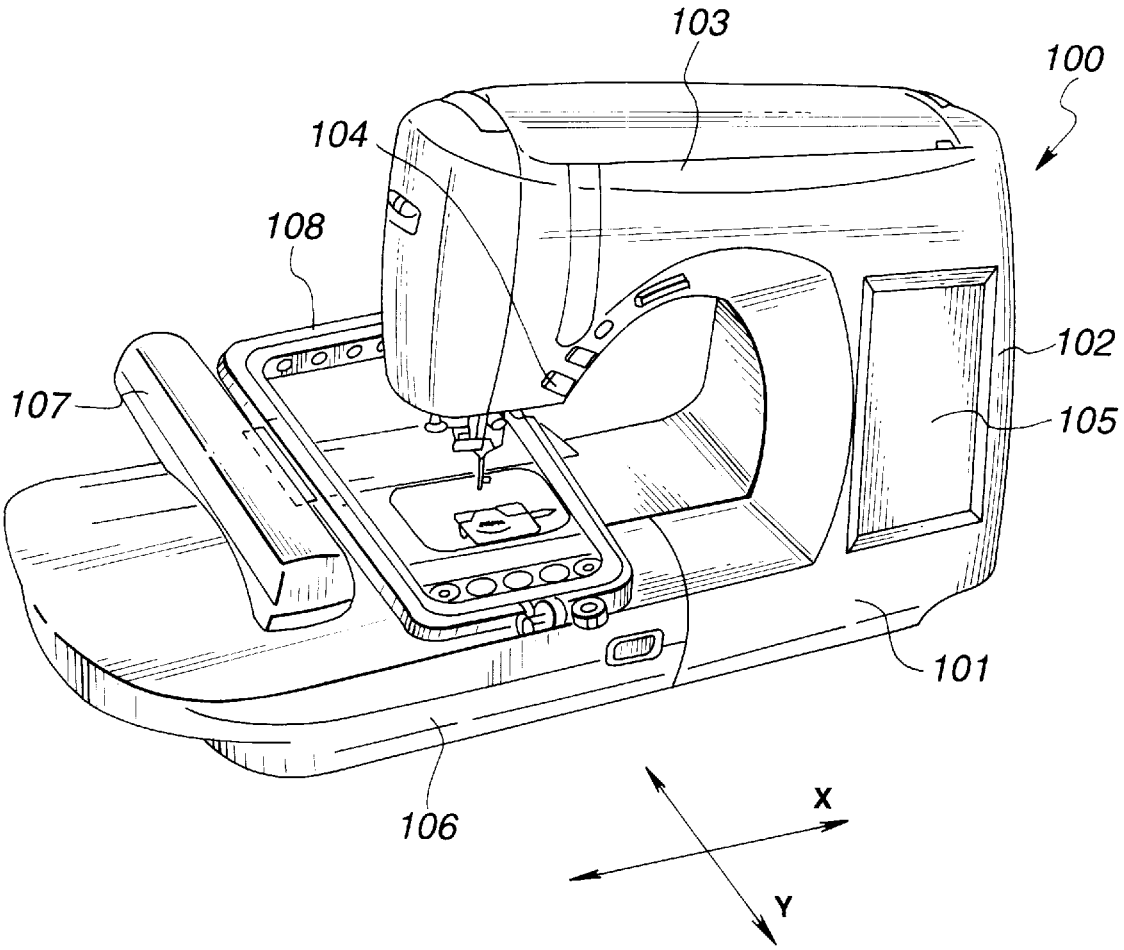
FIG. 37 shows a perspective view schematically showing an embroidery sewing machine incorporating the present invention.

FIG. 37 shows a perspective view schematically showing an embroidery sewing machine incorporating the present invention. In the figure, an embroidery sewing machine 100, a bed 101, a support 102, an arm 103, a start switch 104, a display section 105, an auxiliary bed 106, a carriage 107, and an embrodering frame 108 are shown.

As shown, the start switch 104 is attached to the arm 103; the display section 105 is formed in the support 102; and various screens and related keys, which are to be described later, are visually presented on the screen of the display section 105. The auxiliary bed 106 is removably attached to the bed 101. The carriage 107 is supported on the auxiliary bed 106 while being movable horizontally (in the X-axis directions) and back and forth (in the Y-axis directions). The embroidering frame 108 for holding a work cloth or workpiece therein is removably attached to the carriage 107.

An example of the editing of a composite embroidery of an endless pattern, which includes a plural number of embroidery component patterns is illustrated in FIG. 1, while being laid over a coordinate system with a lattice depicted thereon. In this example, each rectangular block or unit block of the lattice has the size of 24 cm in height (in the X-axis directions) and 13 cm in width (in the Y-axis directions). The unit block is provided corresponding to a large embroidering frame of 24 cm high and 13 cm wide.

Edit areas of the display windows shown in FIGS. 2 to 19 are each defined by a 48 cm high×26 cm wide area and equal to a total area of four adjacent unit blocks (each correspond in size to the embroidering frame) of the lattice when combined. In other words, the length and width of the edit area are respectively four times as long as those of the embroidering frame.

In the example of the composite-embroidery editing shown in FIG. 1, many embroidery component patterns are successively and linearly arrayed on and along the right side of the X-axis (vertical), above the Y-axis (horizontal), and the right side of the vertical line Y4.

In FIG. 1, "A" is an embroidery component pattern "A" vertically arrayed and ranging from a position just above a horizontal line originating from a point X2 to a position just above a horizontal line originating from a point X1; "B" is an embroidery component pattern "B" vertically arrayed and ranging from a position just above the horizontal line from the point X1 but somewhat spaced downward from the bottom (viewed in FIG. 1) of the embroidery component pattern "A" to a position just above a horizontal line originating from a point Xo; "C" is an embroidery component pattern "C" horizontally arrayed and ranging from a position somewhat spaced to the right from the bottom of the embroidery component pattern "B" to a position somewhat spaced to the right from a vertical line beginning at a point Y1; "D" is an embroidery component pattern "D" horizontally arrayed and ranging from a position somewhat spaced to the right from the right end of the embroidery component pattern "C" to a position slightly spaced from a vertical line beginning at a point Y2; "E" is an embroidery component pattern "E" horizontally arrayed and ranging from a position somewhat spaced to the right from the right end of the embroidery component pattern "D" to a position slightly spaced to the right from a position somewhat spaced to the right from a vertical line originating from a point Y3; "F" is an embroidery component pattern "F" horizontally arrayed and ranging from a position somewhat spaced to the right from the right end of the embroidery component pattern "E" to a position somewhat spaced to the right from a vertical line beginning at a point Y4; "G" is an embroidery component pattern "G" vertically arrayed and ranging from a position somewhat spaced from the right end of the embroidery component pattern "F" to a position just above the horizontal line from the point X1; and "H" is an embroidery component pattern "H" vertically arrayed and ranging from a position somewhat spaced upward from the top of the embroidery component pattern "G" to a position just above the horizontal line originating from the point X2.

Further, a series of embroidery component patterns is vertically arrayed above the top of the embroidery component pattern "A", and similarly another series of embroidery component patterns is vertically arrayed above the top of the embroidery component pattern "H".

Figure 2:
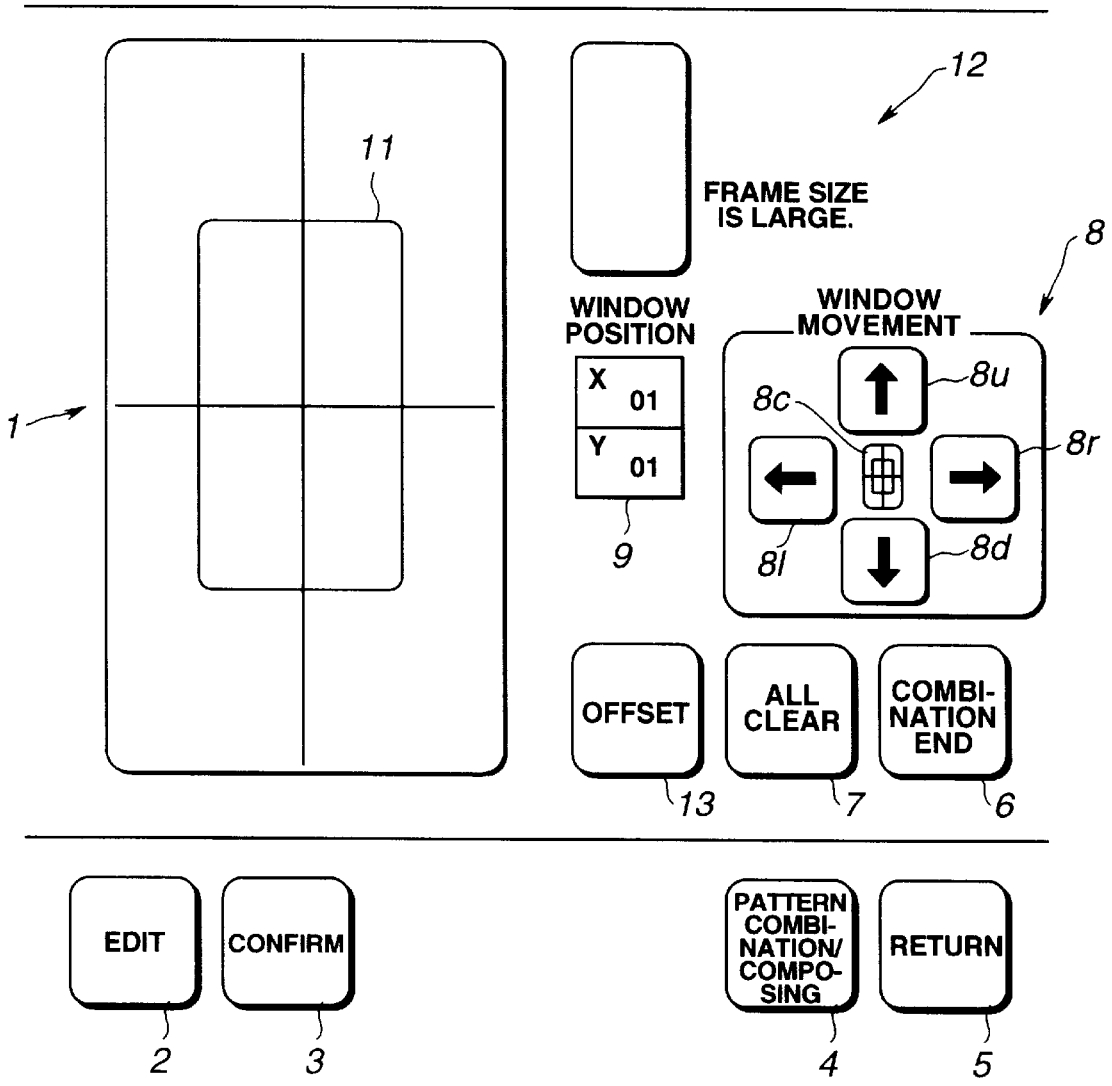
FIG. 2 is a diagram exemplarily showing a screen (initial screen) in the display section of the FIG. 1 embroidery sewing machine when the window position is at (X1, Y1) before the "composite-embroidery area setting (editing)" process is carried out.

FIG. 2 exemplarily shows a screen (initial screen) in the display section of the embroidery sewing machine (not shown) when the window position is at (X1, Y1) before the "composite-embroidery area setting (editing)" process is carried out. In the figure, a display window 1 has an area four times as large as the area of a large embroidering frame (not shown) (see an "embroidering-frame" display 11). The length and width of the display window 1 are respectively four times as long as those of the embroidering frame.

In the description to follow, the area size of the display window 1 of the display section, viz., four times as large as of the embroidering frame, is referred to as "composite-embroidery area size", and also to "window area size".

Further, it is assumed that an area of one of the embroidery component patterns which make up a target or composite embroidery pattern is equal to the area four times as large as of the embroidering frame, viz., it is equal to the "embroidery-component area size".

A large target embroidery pattern as shown in FIG. 1 is embroidered by alternatively repeating the editing process and the sewing process every embroidery component.

In the conventional embroidery sewing machine, the edit area is limited within the area of the "window area size". Therefore, a pattern position may simply be set by merely selecting and touching an "edit" key 2 as a touch key.

In the embroidery sewing machine according to the embodiment of the invention, the edit area does not have a limit, and therefore it is necessary to roughly position a selected embroidery component pattern. For the rough pattern-positioning, the machine uses the following touch keys and display regions as shown in FIG. 2: a "confirmation" key 3, "pattern combination" key 4, "return" key 5, "composition end" key 6, "all clear" key 7, "window movement" key group 8, and "window position" display region 9. Further, the embroidery sewing machine includes a "message" display region 12 for displaying a message "Large frame size", which describes that the "embroidering-frame" display 11 is a large embroidering frame of 24 cm high×13 cm wide, and an "offset" key 13.

The "window movement" key group 8 includes a center key 8*c* and four arrow keys 8*u*, 8*d*, 8*l* and 8*r* arranged above and below the center key 8*c* and on the left and right sides of the center key 8*c*. The "window movement" key group 8 is used for changing a position of the window in order to process a large edit area every "window area size". When the operator touches the center key 8*c* with his finger, the window is centered.

The "window position" display region 9 displays a position of an intersection of reference lines, which is the center of the window, and additionally the names of the reference lines. As shown in FIG. 1, X0 to X4 are assigned to points on the X-axis of the coordinates, and Y1 to Y4 are assigned points on the Y-axis. The names of the X- and Y-coordinates are displayed, together with the coordinates of their intersection, in the "window position" display region 9.

Figure 3:
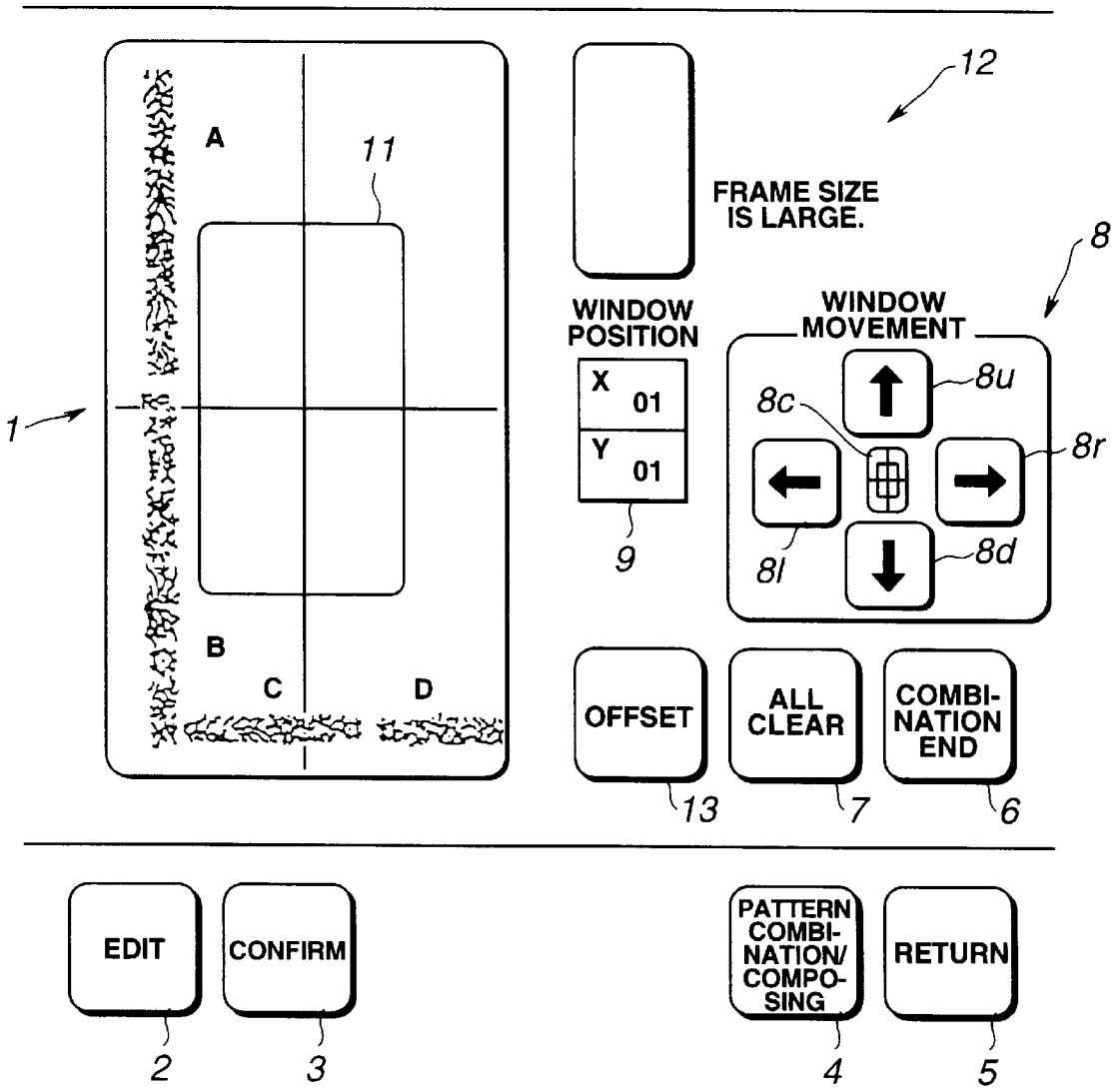
FIG. 3 is a diagram showing a screen containing a display window displaying a layout of embroidery component patterns at (X1, Y1) (window position) and a layout of related touch keys and display regions.

FIG. 3 is an embroidery-pattern screen displayed when the window position is (X1, Y1). The embroidery component patterns "A", "B", "C" and "D" are displayed on the display window 1.

Figure 4:
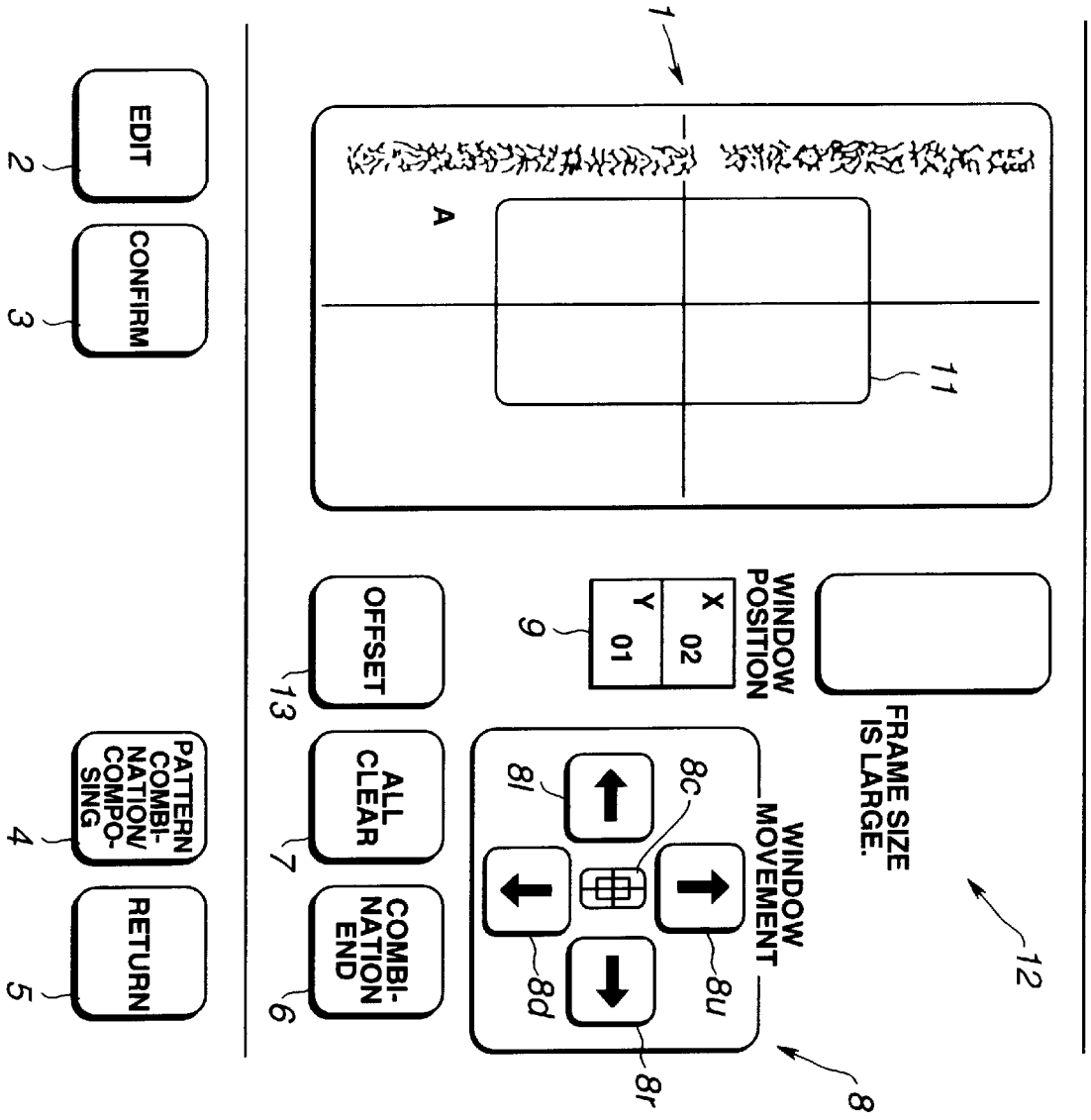
FIG. 4 is a diagram showing a screen containing a display window displaying a layout of embroidery component patterns at (X2, Y1) (window position) and a layout of related touch keys and display regions.

FIG. 4 is an embroidery pattern screen displayed when the window position is (X2, Y1). The embroidery component pattern "A" and the embroidery component pattern located above the former are displayed on the display window 1.

Figure 5:
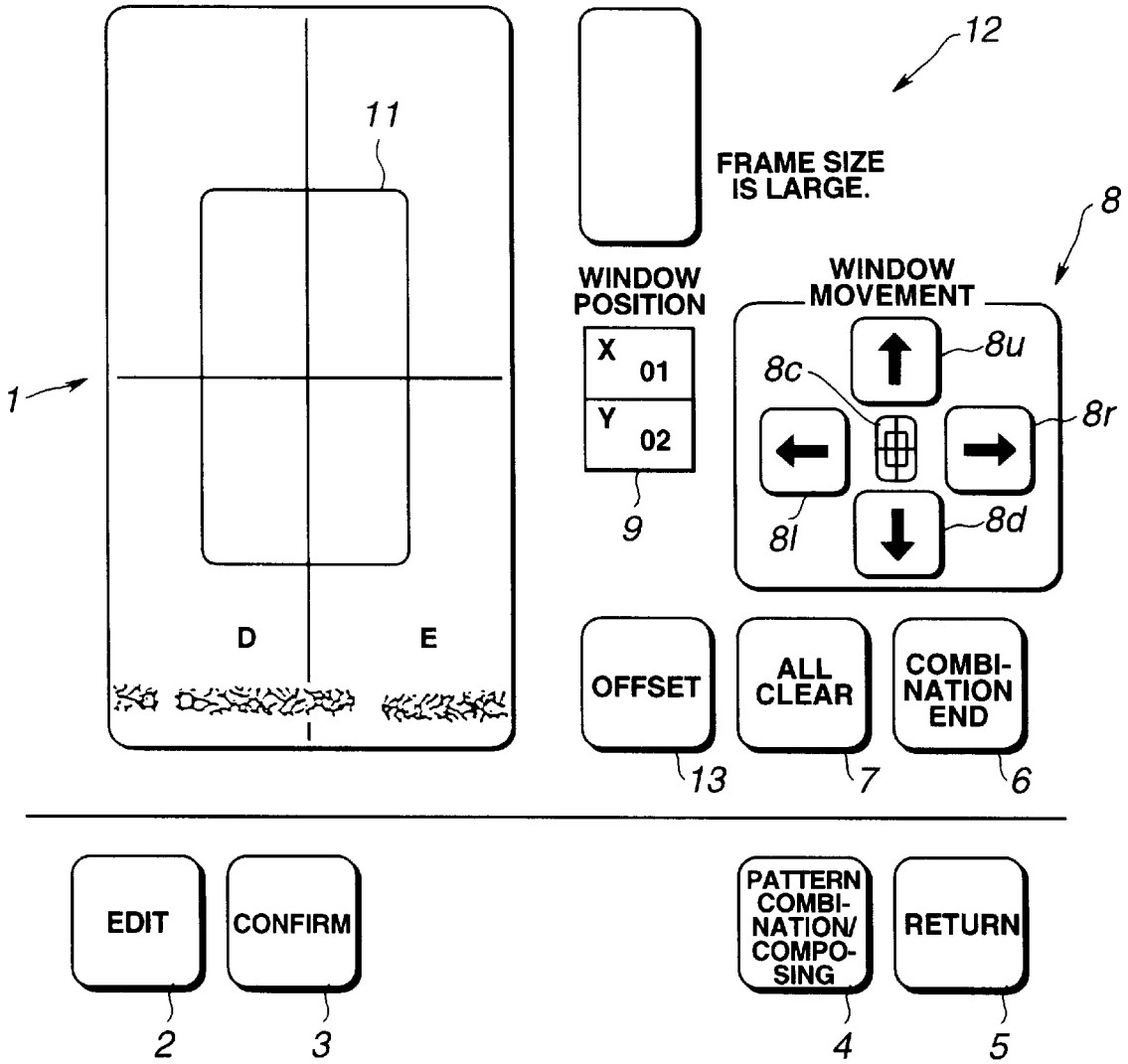
FIG. 5 is a diagram showing a screen containing a display window displaying a layout of embroidery component patterns at (X1, Y2) (window position) and a layout of related touch keys and display regions.

FIG. 5 is an embroidery pattern screen presented when the window position is (X1, Y2). The embroidery component patterns "D" and "E" are displayed on the display window 1.

Figure 6:
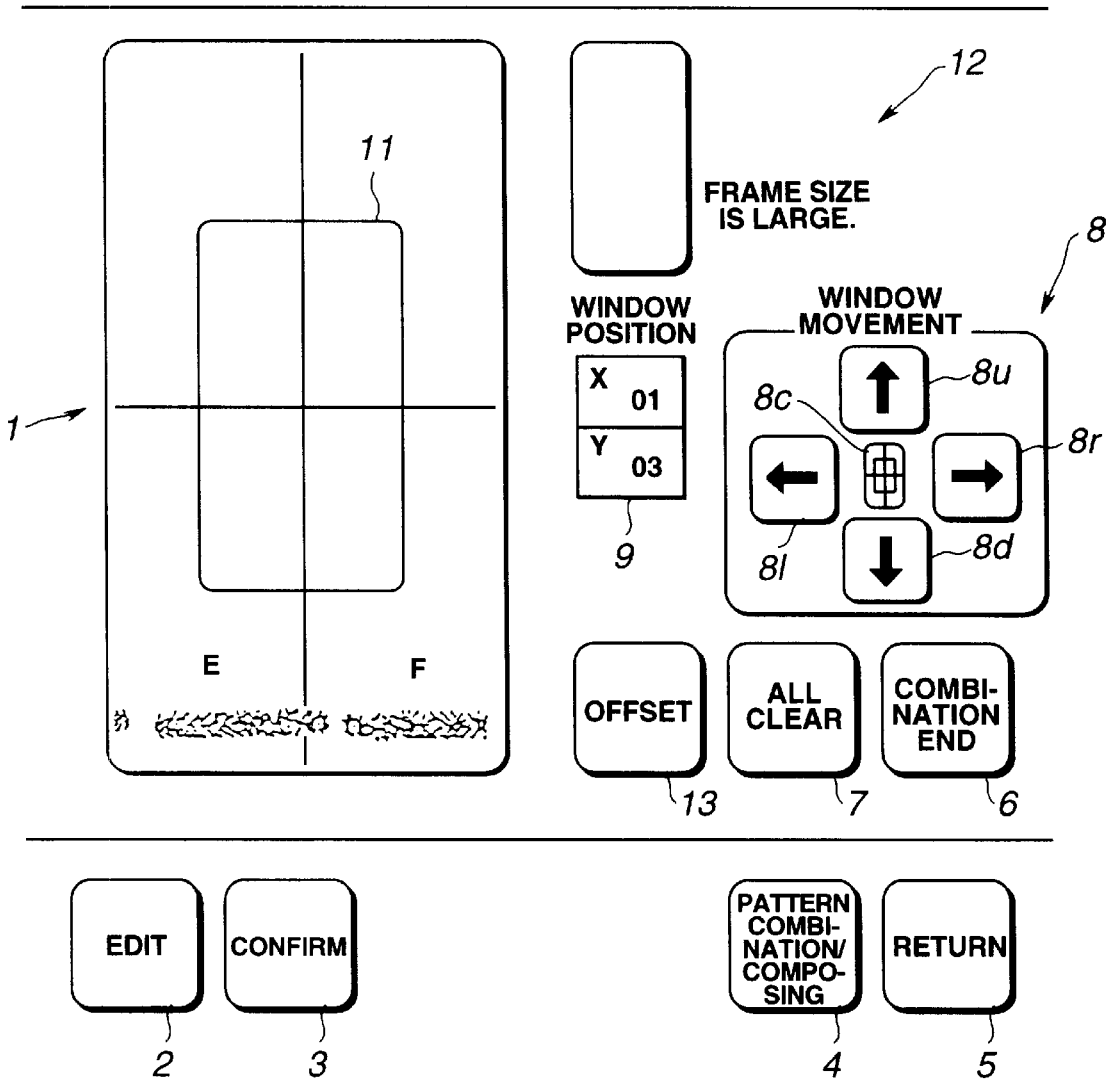
FIG. 6 is a diagram showing a screen containing a display window displaying a layout of embroidery component patterns at (X1, Y3) (window position) and a layout of related touch keys and display regions.

FIG. 6 is an embroidery pattern screen presented when the window position is (X1, Y3). The embroidery component patterns "E" and "F" are displayed on the display window 1.

Figure 7:
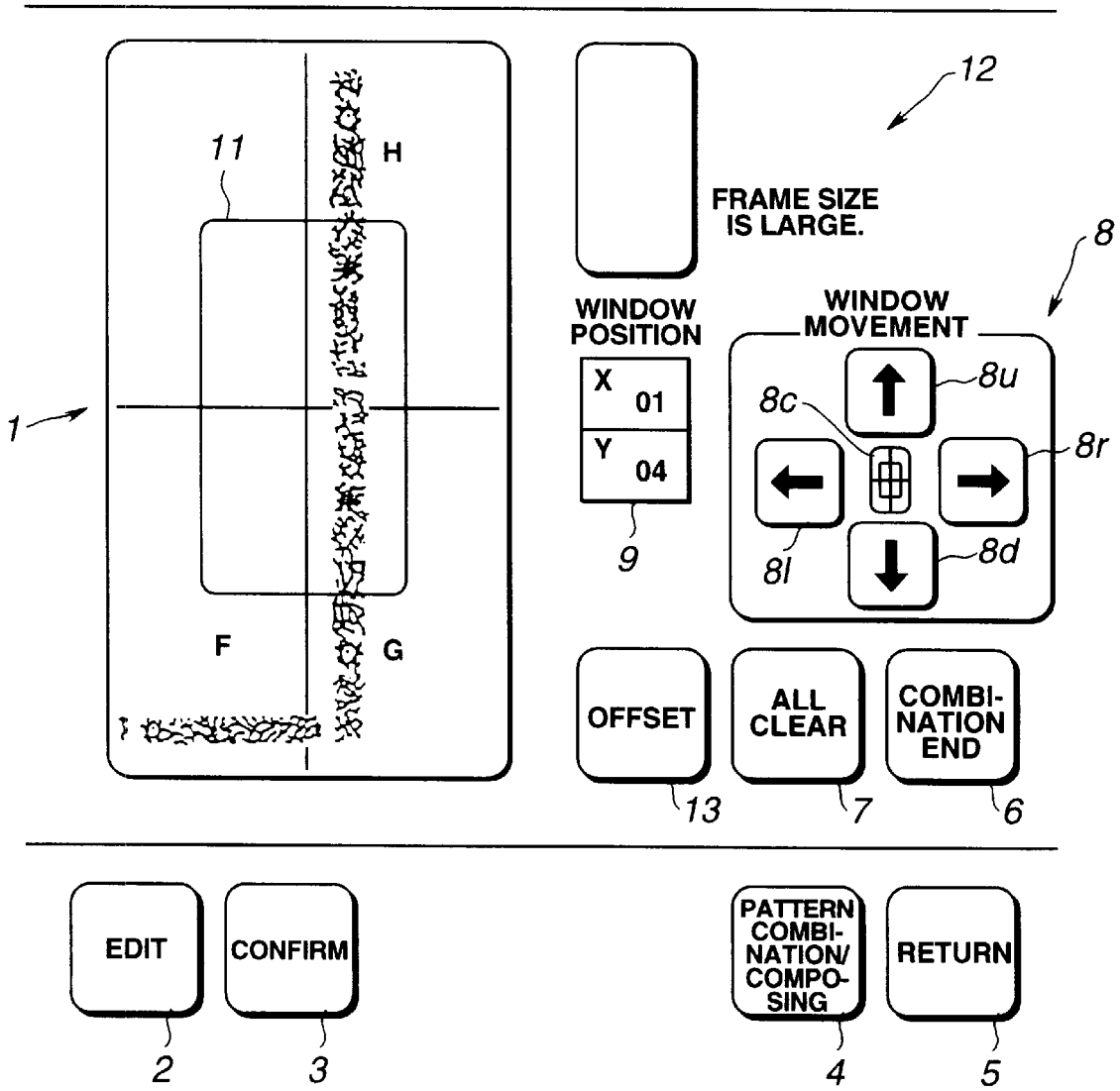
FIG. 7 is a diagram showing a screen containing a display window displaying a layout of embroidery component patterns at (X1, Y4) (window position) and a layout of related touch keys and display regions.

FIG. 7 is an embroidery pattern screen presented when the window position is (X1, Y4). The embroidery component patterns "F", "G" and "H" are displayed on the display window 1.

Thus, FIGS. 3 through 7 show the screens displayed after the embroidery component patterns which, when composed, form an endless embroidery pattern, or a target embroidery pattern, are laid out.

Figure 18:
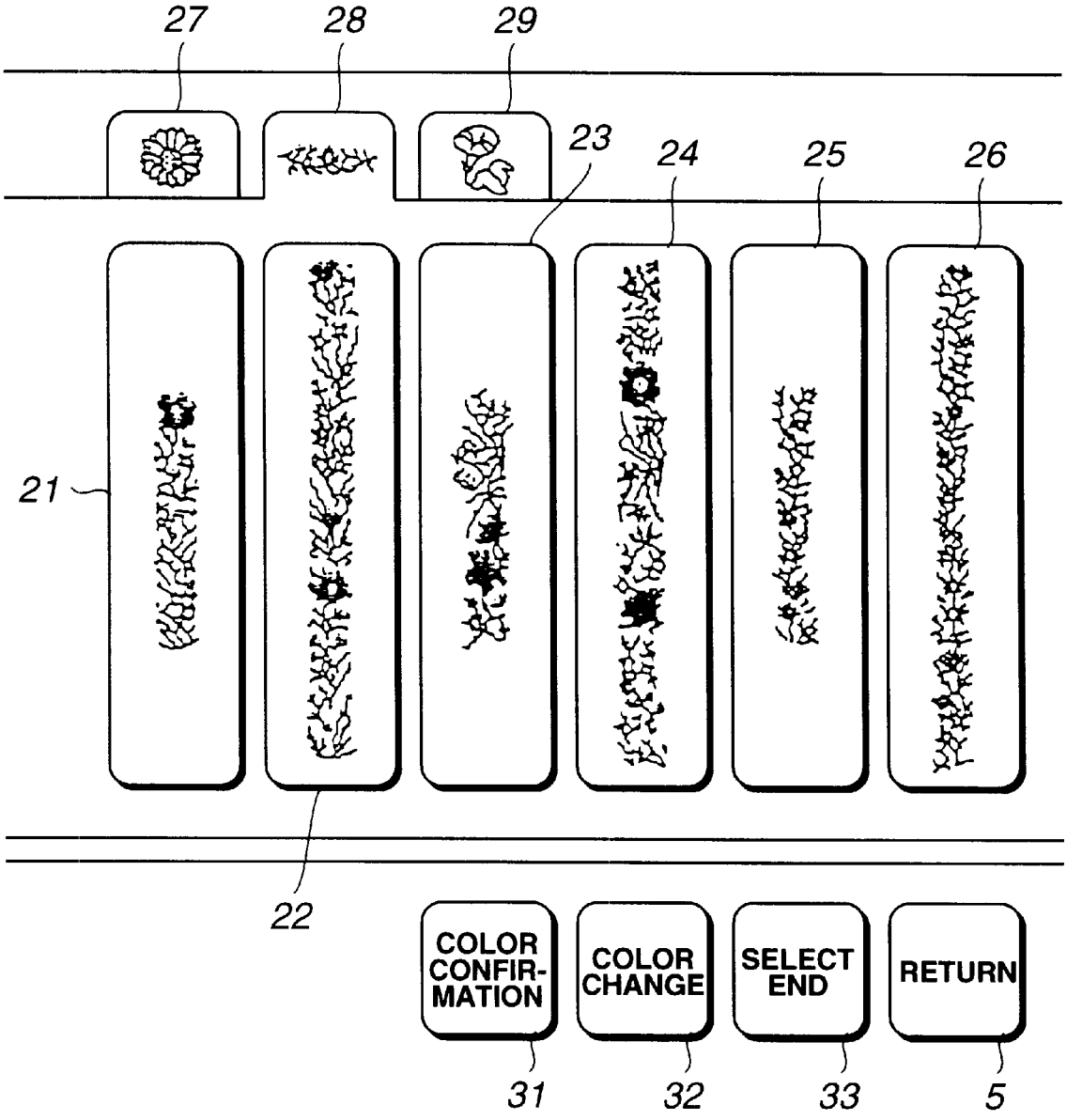
FIG. 18 is a diagram showing a screen presented for choosing a desired embroidery component pattern.

For choosing of the embroidery component patterns, reference is made to FIG. 18. To select a desired component embroidery pattern, an operator views various embroidery component patterns (stored in an internal memory or an external memory (e.g., a memory card) of "pattern" keys 21 to 29, selects his desired component pattern, and touches its "pattern" key; touches a "color confirmation" key 31; if necessary, touches a "color change" key 32; and touches a "select end" key 33. After touching the "select end" key 33, the screen on the display window 1 is returned to the initial screen of FIG. 2.

Figure 16:
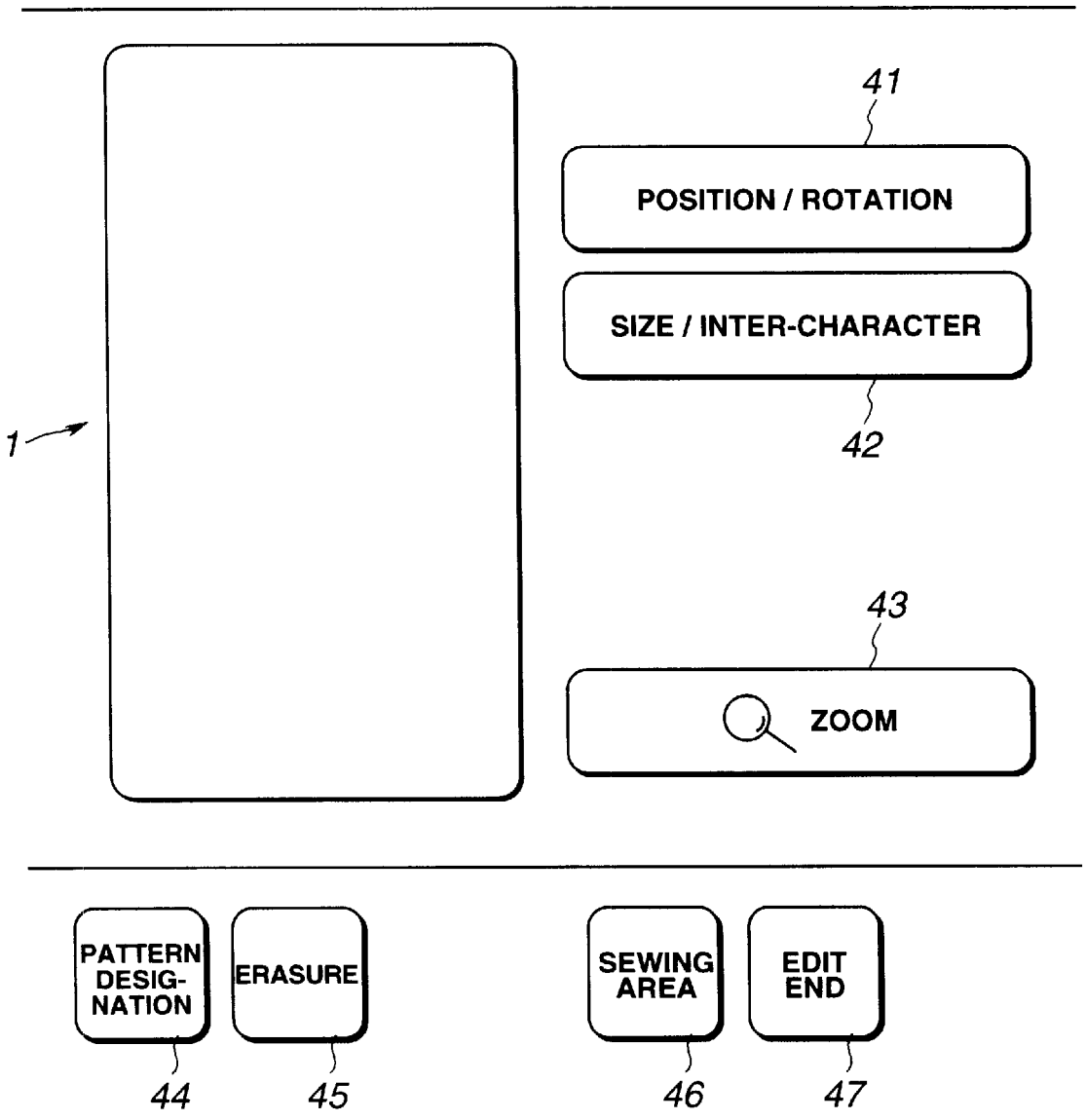
FIG. 16 is a diagram showing a screen for a "position, rotation, mirror" process.

To edit the selected embroidery component patterns, the operator touches the "edit" key 2 in the initial screen of FIG. 2, and then the screen is changed to that shown in FIG. 16.

The screen of FIG. 16 contains a "position/rotation" key 41, a "size/inter-character" key 42, a "smooth" key 43, a "pattern designation" key 44, an "erasure" key 45, a "sewing area" key 46, and an "edit end" key 47. To edit, the operator properly uses those keys 41 to 46. At the end of the editing, he touches the "edit end" key 47, and the screen is returned to the FIG. 2 screen.

If he touches the "sewing area" key 46, the embroidering frame moves to show a sewing position.

Figure 17:
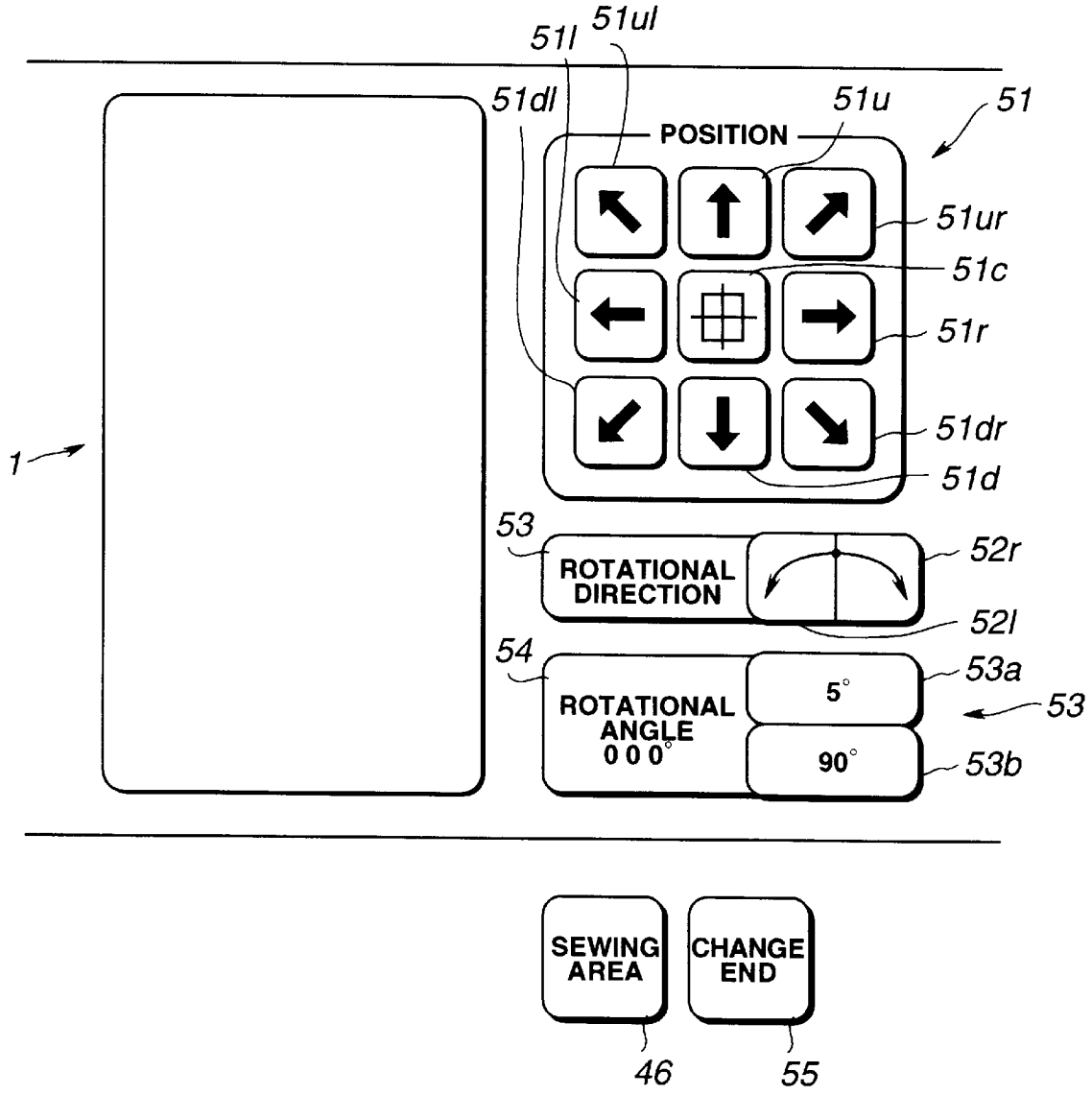
FIG. 17 is a diagram showing a screen presented when a "position/rotation" key is operated.

If the "position/rotation" key 41 is touched on the screen of FIG. 16, the screen is changed to a screen of FIG. 17.

As shown, a "position" key group 51, a "turning direction" key pair 52 and a "rotational angle" key pair 53 are provided for the edit for positioning and rotation. For this edit, those keys are used while properly combined.

A "rotational angle" display region 54 is located adjacent to the "rotation angle" key pair 53, and a "change over" key 55 is located under the "rotational angle" key 53.

The "position" key group 51 consists of eight arrow keys 51*u*, 51*d*, 51*l*, 51*r*, 51*ul*, 51*ur*, 51*dl*, and 51*dr*, and a center key 51*c* surrounded by those arrow keys as shown. If the center key 51*c* is touched, the sewing position is returned to the center of the embroidering area.

The "turning direction" key pair 52 has a left-turn key 52*l* and a right-turn key 52*r*.

The "rotational angle" key 53 consists of a 5°-turn key 53*a* and a 90°-turn key 53*b*. The 5°-turn key 53*a* is capable of turning the embroidery pattern at the steps of 5°, and the 90°-turn key 53*b* is capable of turning the embroidery pattern at the steps of 90°. A total angle of the angles of the turning by those keys is displayed in the "rotational angle" display region 54.

After the positioning and the rotational angle are set up, the operator touches the "change over" key 55. Then, the screen is returned to the original screen (FIG. 16).

The process of the composite-embroidery editing is carried out by editing means constructed by utilizing a part of the CPU contained in the embroidery sewing machine. Thus, the editing means has an enlarging function to edit the embroidery component patterns in an enlarged fashion, when comparing with the conventional one.

The edit area may be enlarged infinitely in principle. The relative positions of the embroidery component patterns can be secured if position information on the embroidery component patterns is stored in terms of absolute positions. Actually, a position resolution (0.1 mm) and the memory capacity (in byte) of a memory for storing the absolute positions place a limit to the enlarging of the edit area. In an example where the unit length of 0.1 mm and 2 bytes assigned to the unit length are used for expressing the position information, an area of about 6.5 $mm^2$ can be expressed.

There is a case where the embroidery component patterns need to be joined together to form a composite embroidery pattern in the edit area substantially equal to such a limited area. This case and the following case are processed in the following manner. Let us consider an example where for a large composite embroidery of 1 m long, embroidery component patterns of it are sequentially sewed in the order from left to right in such a way that a first embroidery component pattern is sewn, a second embroidery component pattern is sewn in addition to the first embroidery component pattern sewn, and so on. In this case, the sewing of the embroidery component patterns progresses in a repeated manner. When the patterns of about 50 cm long have been joined, an edit mode is set up. The edit area is slid plural number of times to add the embroidery component patterns. The embroidery component patterns having been processed need to be erased.

Following the editing process mentioned above, a "sewing area by the embroidering frame" is set before the sewing process. The setting of the "sewing area by the embroidering frame" will be described hereunder.

After the editing process ends, it is necessary to select a sewing position by use of the "window movement" key group 8 (FIG. 19) before the sewing process is executed.

Figure 19:
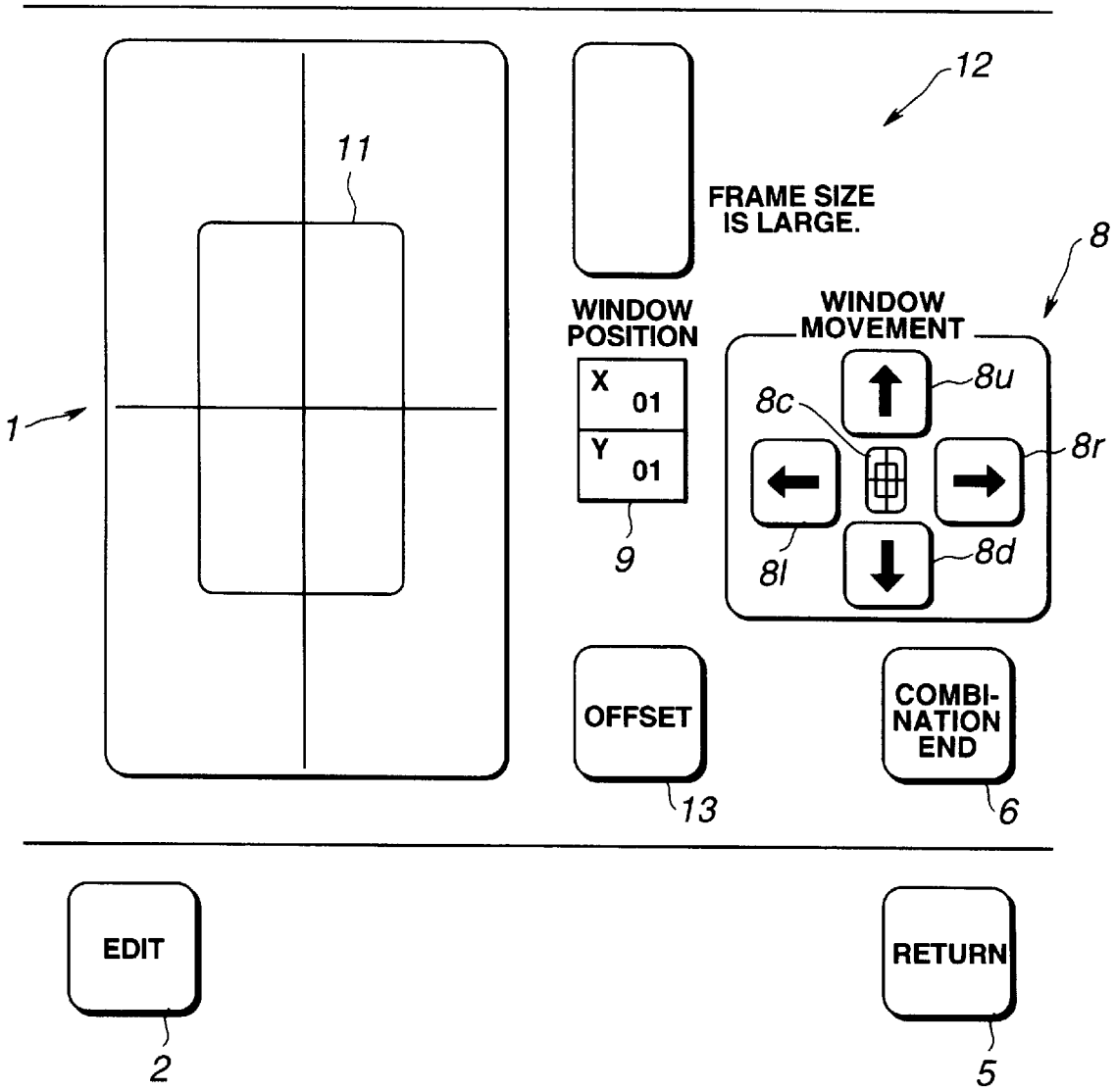
FIG. 19 is a diagram showing a screen presented before the process of "composite-embroidery area setting (sewing)", a display in the display window is set at (X1, Y1)

In the screen of FIG. 19, the keys on the edit are omitted.

A position of the window is determined on the screen of FIG. 19, and then the "sewing area by the embroidering frame" is set.

Figure 8:
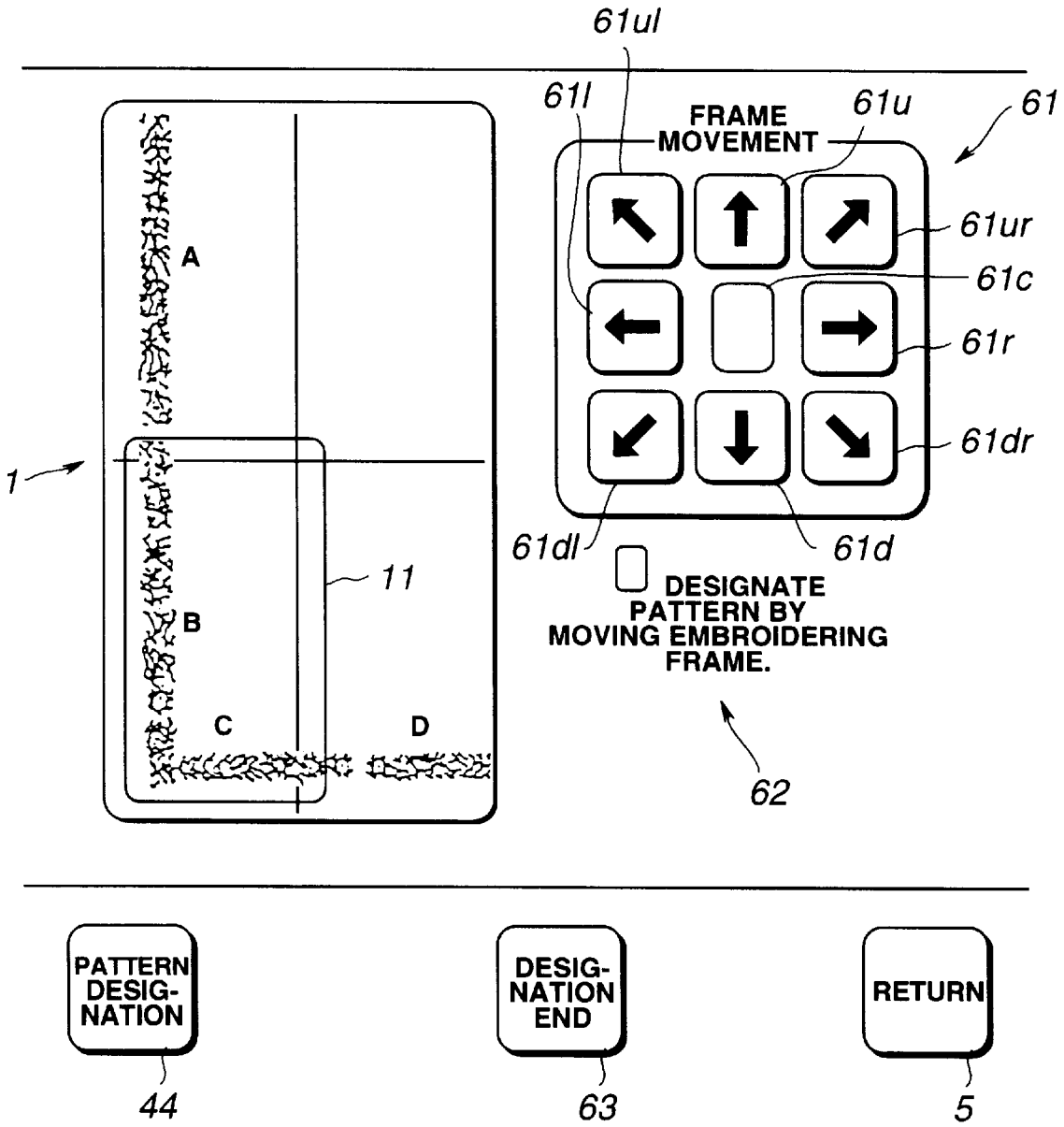
FIG. 8 is a diagram showing a screen containing a display window and a layout of related touch keys and display regions, the diagram useful in explaining how to set the "sewing area by the embroidering frame", the positions of the embroidering frame and the reference lines for this area setting being displayed in the window.

The screen of FIG. 8 is used for setting the "sewing area by the embroidering frame". The FIG. 8 screen contains a "frame movement" key group 61, a message display region 62 for displaying a message "designate a pattern to be sewn by moving the embroidering frame", and a "designation end" key 63. In the screen, the embroidery component pattern "B" is designated as shown.

The "frame movement" key group 61 consists of eight arrow keys 61*u*, 61*d*, 61*l*, 61*r*, 61*ul*, 61*ur*, 61*dl*, and 61*dr*, and a center key 61*c* surrounded by those arrow keys as shown. When the center key 61*c* is touched, the sewing position is returned to the center of the embroidering area.

Figure 9:
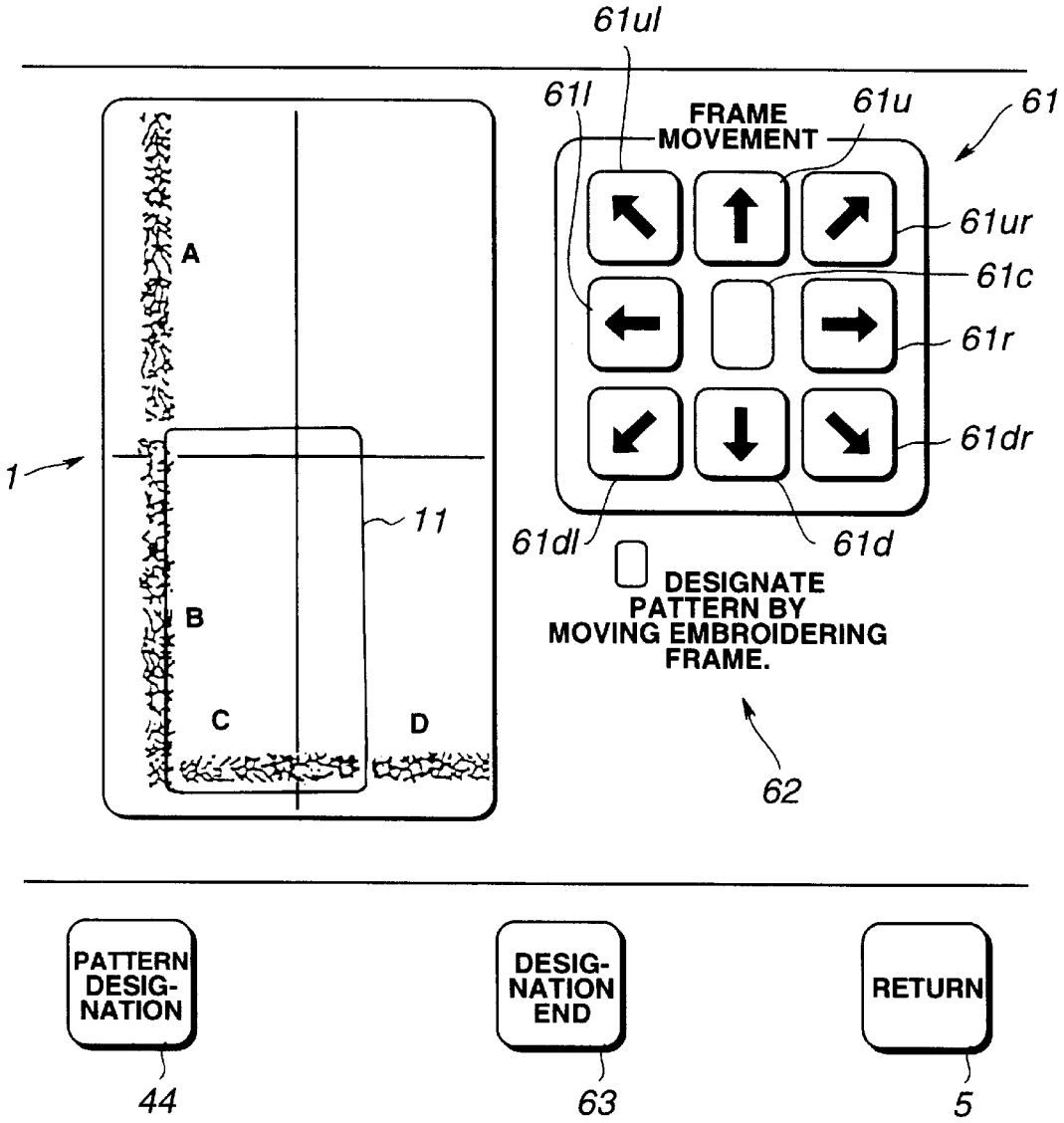
FIG. 9 is a diagram showing a screen containing a display window and a layout of related touch keys and display regions, the diagram useful in explaining how to set the "sewing area by the embroidering frame", the positions of the embroidering frame and the reference lines displayed in the window being different from those in FIG. 8.

FIG. 9 shows a screen containing an embroidering frame, which is different from that in FIG. 8, and the positions of the reference lines. In the screen of FIG. 9, the embroidery component pattern "C" is designated.

Figure 10:
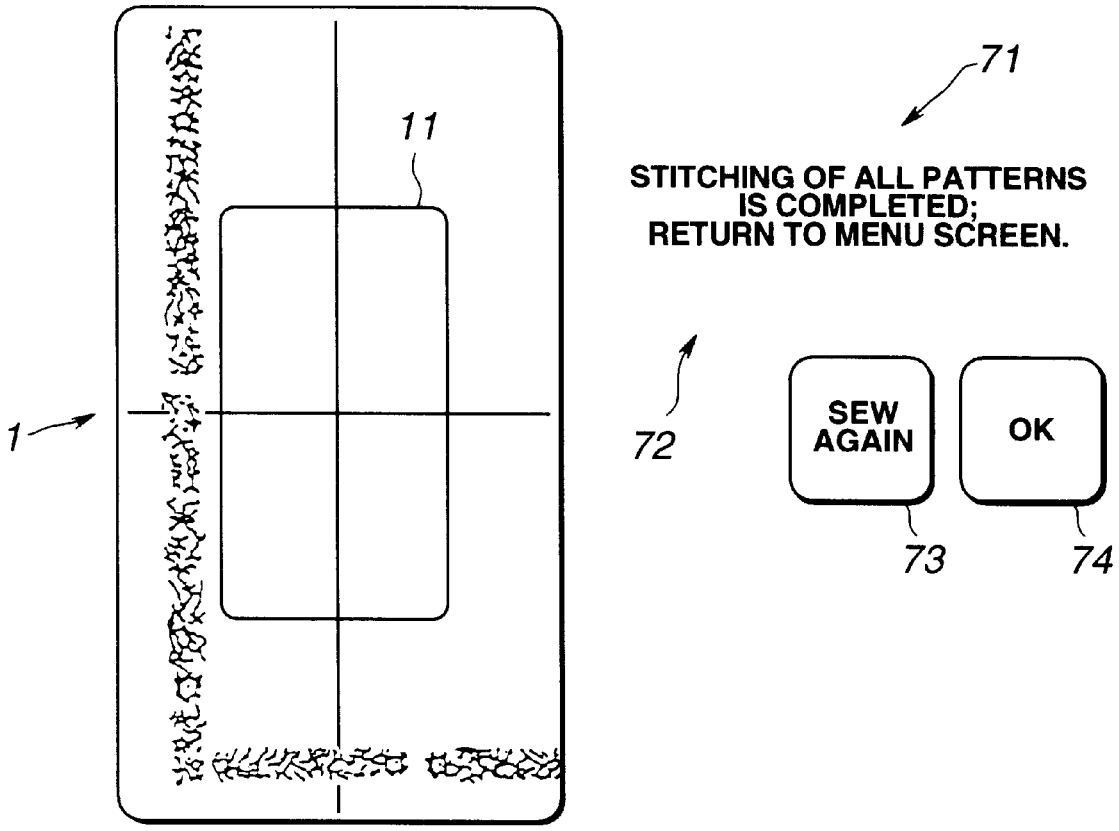
FIG. 10 is a diagram showing a screen for a sewing-end message.

FIG. 10 shows a screen for a sewing-end message. The screen contains a "Sewing of all patterns is completed" message display region 71, a "return to the menu screen" message display region 72, a "sew again" key 73, and an "OK" key 74.

Figure 11:
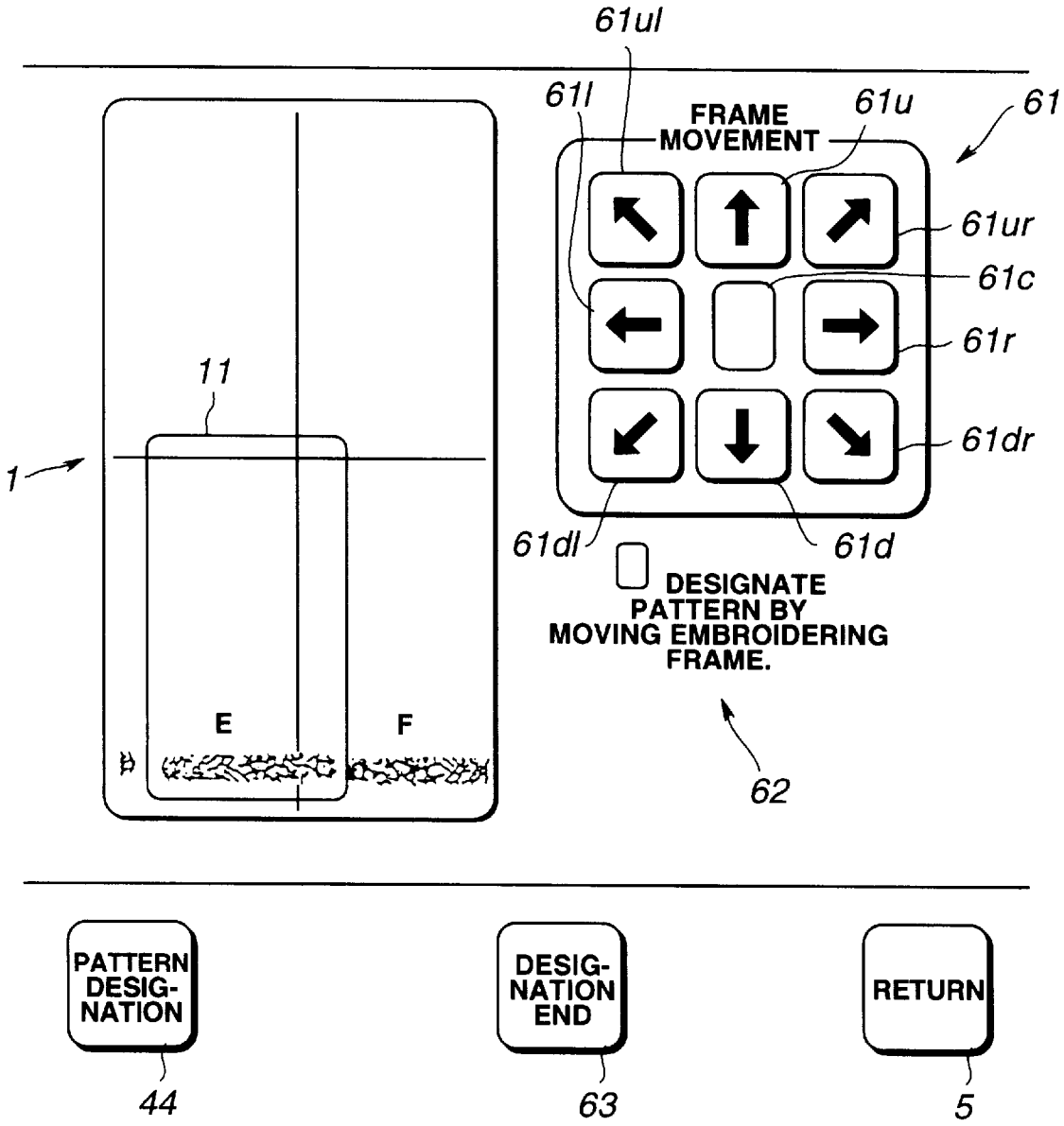
FIG. 11 is a diagram showing a screen for setting a sewing area by the frame size.

FIG. 11 is a screen for setting a sewing area by the frame size, and as shown, the embroidery component pattern "E" is set in the screen.

Figure 12:
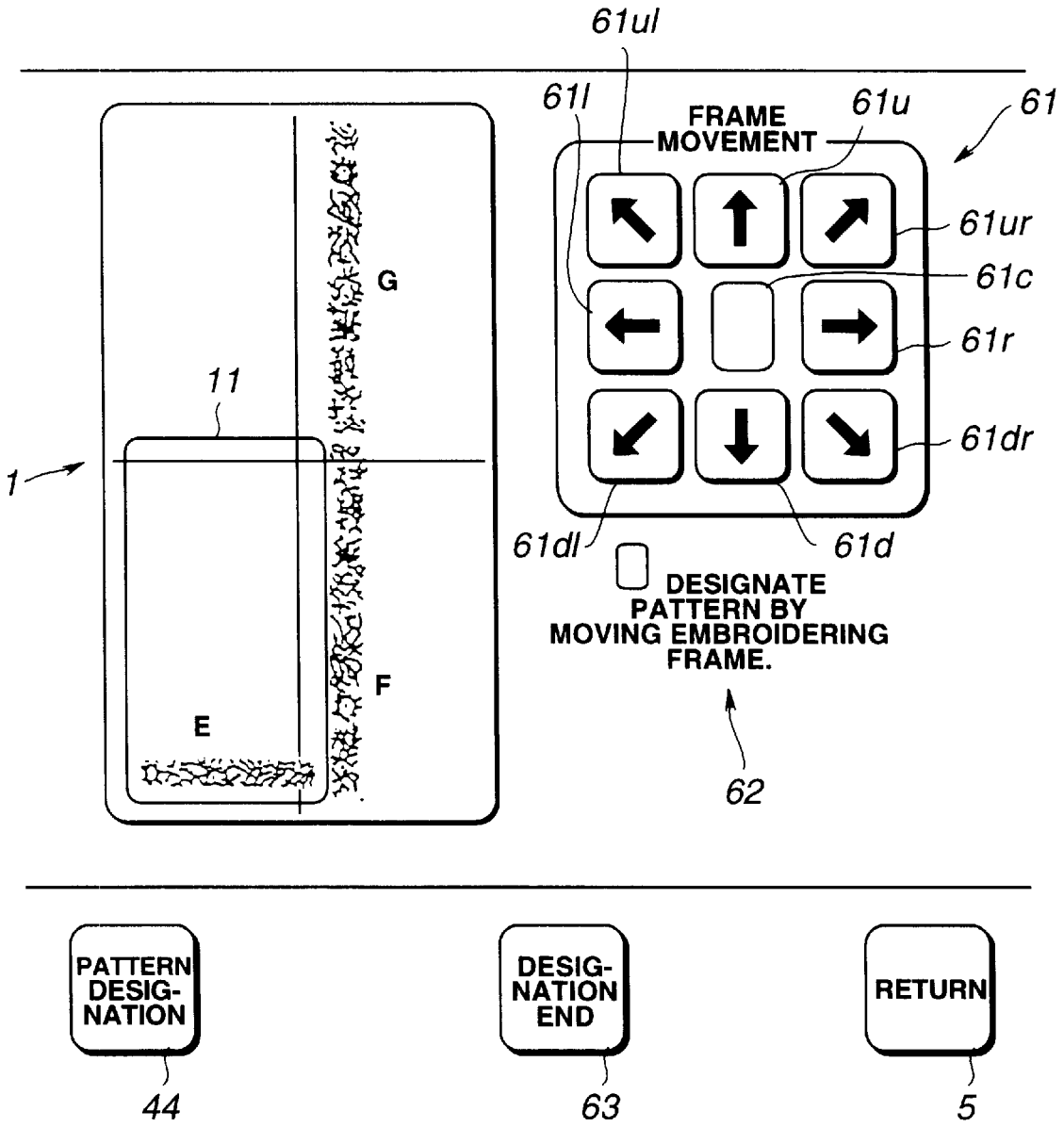
FIG. 12 is a diagram showing a sewing-area setting screen different from the screen of FIG. 11.

FIG. 12 is a sewing-area setting screen different from the screen of FIG. 11, and as shown, the embroidery component pattern "F" is set in the screen.

Figure 13:
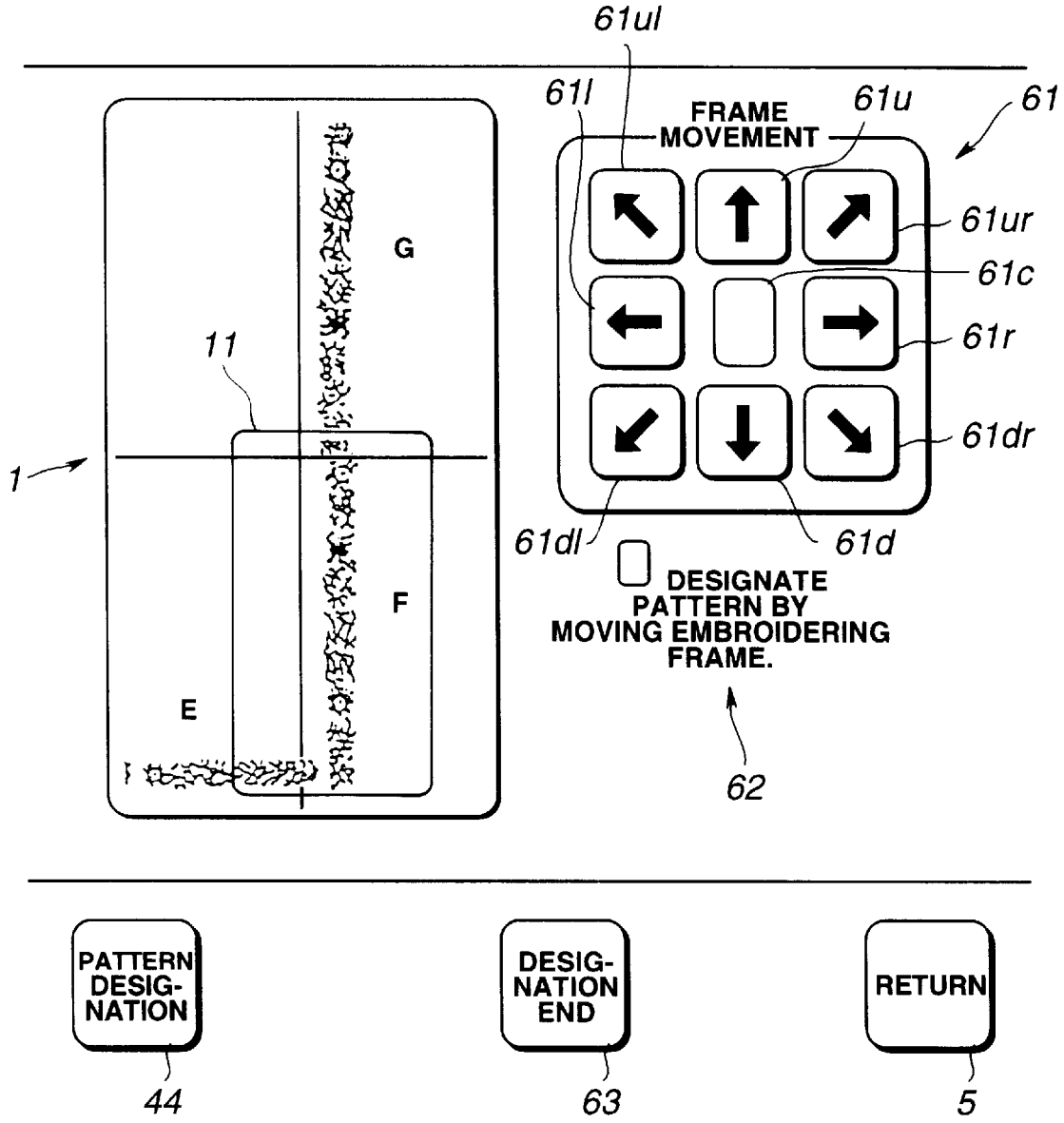
FIG. 13 is a diagram showing a sewing-area setting screen different from the screens of FIGS. 11 and 12.

FIG. 13 is a sewing-area setting screen different from the screens of FIGS. 11 and 12, and as shown, the embroidery component pattern "G" is set in the screen.

Figure 14:
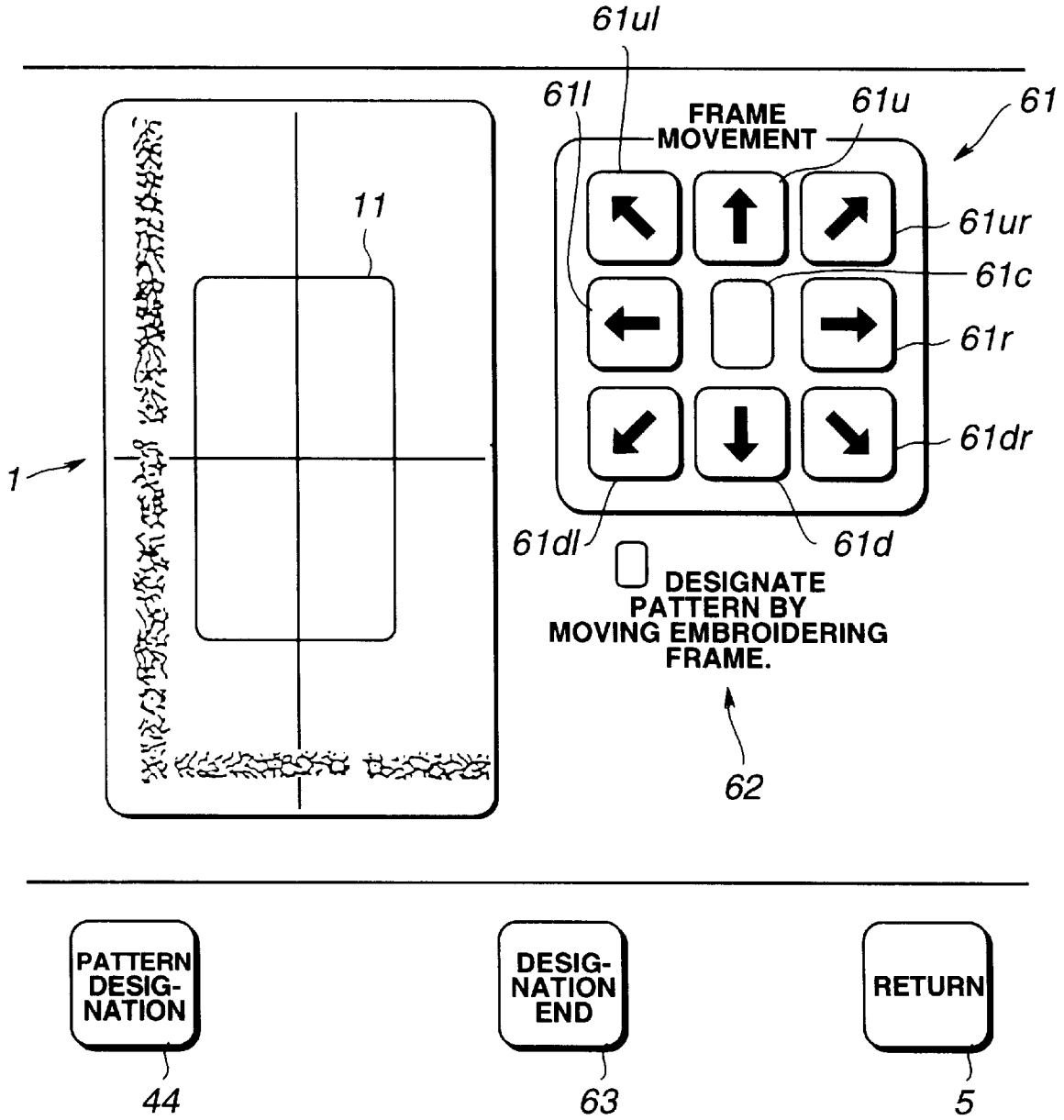
FIG. 14 is a diagram showing a screen before the setting of a sewing area by the frame size.

FIG. 14 is a screen before the setting of a sewing area by the frame size.

Figure 15:
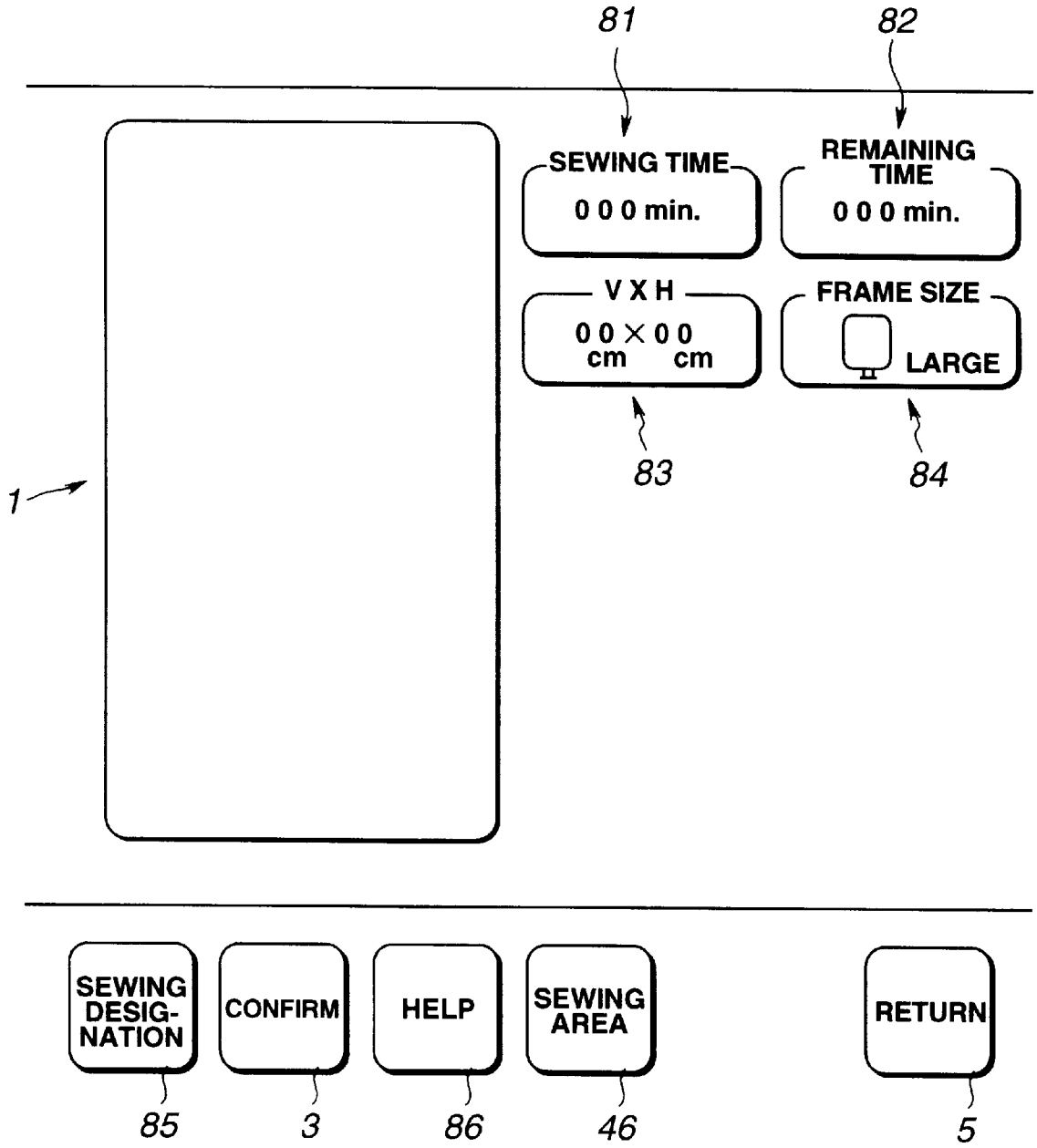
FIG. 15 is a diagram showing a screen when the sewing progresses.

FIG. 15 is a screen when the sewing progresses. The screen contains a "sewing time" display region 81, a "remaining time" display region 82, a "vertical/horizontal" display region 83, a "frame size" display region 84, a "sewing designation" key 85, and a "help" key 86.

Before the sewing process, vertical and horizontal straight lines as reference lines are drawn in a lattice or matrix fashion on a work cloth on which embroidery component patterns are to be sewn. The length between the adjacent horizontal reference lines parallel to each other and the length between the adjacent vertical reference lines also parallel to each other are substantially equal to (equal to or slightly shorter than) the corresponding ones defming the sewable area of the embroidering frame.

The embroidery component pattern or patterns are laid out in the unit or rectangular block of the lattice thus drawn on the work cloth. The embroidery component pattern or patterns laid out within four unit blocks constitute one of the embroidery component patterns which, when combined together, form one complete composite embroidery, or a target embroidery pattern.

The lengths of the reference lines may properly be selected irrespective of the size of the embroidering frame; however, the area of one embroidery component pattern needs to be four times as large as the area of the embroidering frame used. The reason for this is that when a sewing area is designated and the reference lines are designated, it is required that X- and Y-axis lines, each at least one in number, are contained in one segmental embroidery area.

The sewing process of the thus editorially joined embroidery pattern, or the target embroidery pattern, is carried out by sewing means constructed with a part of the CPU contained in the embroidery sewing machine. Thus, the sewing means has a function to sew the composite embroidery pattern extended in area when comparing with the conventional one.

The function of the "offset" key 13 (FIG. 2) will be described.

As already referred to, the editing process or sewing process is carried out every "window."

Therefore, it is necessary to set the "window" every time a embroidery component pattern or patterns are selected and edited. This operation is troublesome.

One of the best ways to avoid this is to store the position of the window being currently used when the editing/sewing process is carried out.

Where the window position is stored, the embroidering-area setting screen (common to both the editing and sewing processes) is automatically presented at the stored window position.

A part of the RAM contained in the embroidery sewing machine is used as storing means for storing the embroidering area setting screen.

A process containing the work of editing embroidery component patterns into a composite embroidery and the process of sewing the composite embroidery pattern will be described by use of flow charts shown in FIGS. 20 to 36.

FIGS. 20 and 21 cooperatively show a general flow chart showing a composite-embroidery sewing process. In the flow chart, a power switch is turned on of the embroidery sewing machine in a step S1. Then, an "initial screen" is displayed on the screen of the display section (step S2). In this instance, the "initial screen" is the edit screen at the window position (X1, Y1) (FIG. 2).

In a step S3, a "combination/composing-mode select" screen is displayed. On this screen, the "pattern combination" key 4 is displayed (FIG. 2).

A subroutine shown in FIG. 22 is carried out before the "combination/composing-mode select" screen is displayed.

FIG. 22 is a flow chart showing a subroutine (1) in the general flow chart of FIG. 20. In the subroutine, the "embroidery key" of the function key of the embroidery sewing machine is turned on (step S21), and a "confirmation message" indicating that the embroidery mode is set up is displayed (step S22).

It is determined as to whether or not the embroidery mode is cleared by use the clear key (step S23). If it is not cleared, a process to return to the original screen is executed (step S24). If it is cleared, a process "clear all data" is executed (step S25), and the step S3 in the general flow of FIG. 20 is executed.

The process of FIG. 22, or the process (1) in the general flow of FIG. 20, is valid for any screen.

Description is turned to the routine of FIG. 20.

Following the "combination/composing-mode select" process (step S3), a "pattern select" process is executed (step S4).

To select a desired embroidery component pattern, the operator views various embroidery component patterns (stored in an internal memory or an external memory (e g., a memory card) of "pattern" keys 21 to 29, selects his desired component pattern, and touches its "pattern" key; touches the "color confirmation" key 31; if necessary, touches the "color change" key 32; and touches the "select end" key 33. Upon touching the "select end" key 33, the "pattern select" process is executed. Then, a "reference position readout" process is executed (step S5 in FIG. 20).

The "initial screen" is displayed on the screen of the display section (step S2), viz., the edit screen at the window position (X1, Y1) is displayed in the display window 1.

Subsequently, the "composite-embroidery area setting (editing)" process is carried out (step S6).

Specifically, the "edit" key 2 is touched on the initial edit screen of FIG. 2. Upon touching the "edit" key 2, subroutines flow charted in FIGS. 23 to 29 are executed.

FIG. 23 is a flow chart showing a subroutine of the step S6 (composite-embroidery area setting (editing)") in the general flow of FIG. 20. In the subroutine, a step 61 is executed to display the "embroidering-area setting" screen for editing, and a step S62 is executed to judge whether or not any, some or all of the arrow keys 8*u*, 8*d*, 8*l*, 8*r* of the "window movement" key group 8 is touched.

If any of the arrow keys is touched, a step S63 is executed to judge whether or not the "offset" key 13 is touched. If any of the arrow keys is touched, the subroutine of FIG. 24 is executed.

Figure 24:
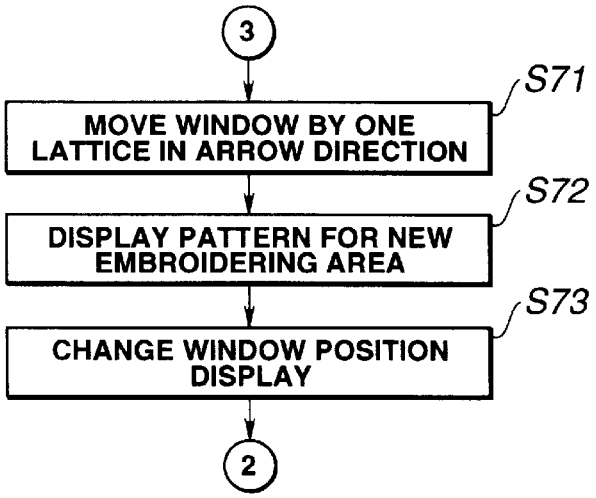
FIG. 24 is a flow chart showing a process (3) in the FIG. 23 flow chart.

In the FIG. 24 subroutine, a step S71 is executed to move the window, or the display window 1, in the direction indicated by the arrow head of the touched key, by one unit block area of the lattice on the screen (FIGS. 3 through 7).

A step S72 is executed to sequentially display the screens showing additional embroidery component patterns (FIGS. 3 through 7). A step S73 is executed to change the position of the window position display.

At this time, the reference position coordinates (X1, Y1), (X2, Y1), (X1, Y2), (X1, Y3), (X1, Y4), and so on with respect to the origin coordinates (Xo, Yo) are stored into a proper memory, e.g., RAM, and the program returns to the step S62 in the FIG. 23 subroutine.

In the FIG. 23 subroutine, if the "offset" key 13 is not touched in the step S63, a step S64 is executed to judge whether or not the "all clear" key 7 is touched. If the key 13 is touched, a step S74 (FIG. 25) is executed.

Figure 25:
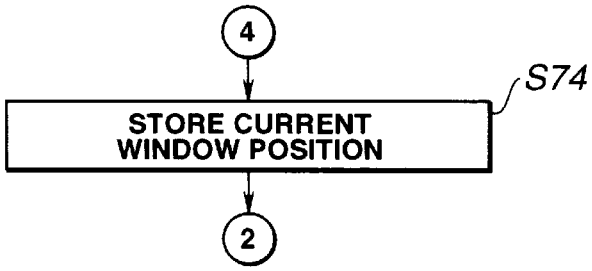
FIG. 25 is a flow chart showing a process (4) in the FIG. 23 flow chart.

In the process of the step S74 in FIG. 25, the current window positions are stored; upon touching of the "offset" key 13, the reference points coordinates (X1, Y1), (X2, Y1), (X1, Y2), (X1, Y3), (X1, Y4), and so on are stored into the sewable-area frame position storing means formed by a part of the RAM. Then, the program returns to the step S62 in FIG. 23.

The display window 1, which will be displayed in the subsequent editing process, will be positioned at the stored window positions.

If the "all clear" key 7 is not touched in the step S64 (FIG. 23), a step S65 is executed to judge if the "return" key 5 is touched. If it is touched, a process of FIG. 26 is executed.

Figure 26:
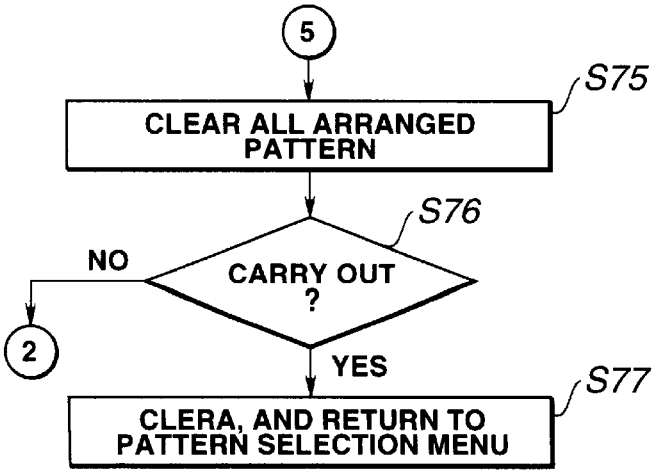
FIG. 26 is a flow chart showing a process (5) in the FIG. 23 flow chart.

In the process of FIG. 26, a step S75 is executed to display a message "erase all the patterns laid out" since the "all clear" key 7 is touched. A step S76 is executed to judge if the erasing of all the patterns is to be executed (by touching an execution key (not shown)).

If the erasing is to be executed (the execution key is rendered on), a step S77 is executed to erase all the patterns and to return to the pattern select menu screen (FIG. 18). If the erasing is to not be executed (the execution key is rendered off), the program returns to the step S62 in the subroutine of FIG. 23.

If the "return" key 5 is not touched in the step S65 in FIG. 23, a step S66 is executed to judge if the "pattern combination" key 4 is touched. If the answer is YES, the program advances to a process of FIG. 27.

Figure 27:
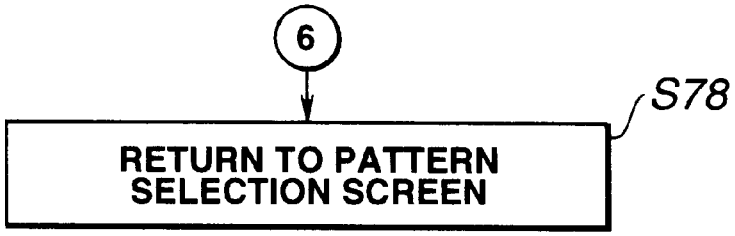
FIG. 27 is a flow chart showing a process (6) in the FIG. 23 flow chart.

In the FIG. 27 process, a step S78 is executed to return to the pattern select screen (FIG. 18) since the "return" key 5 is touched.

If the answer is NO (the "pattern combination" key 4 is not touched) in the step S66 in FIG. 23, a step S67 is executed to judge if the "composition end" key 6 is touched. If the "pattern combination" key 4 is touched in the step S66, the program advances to a process of FIG. 28.

Figure 28:
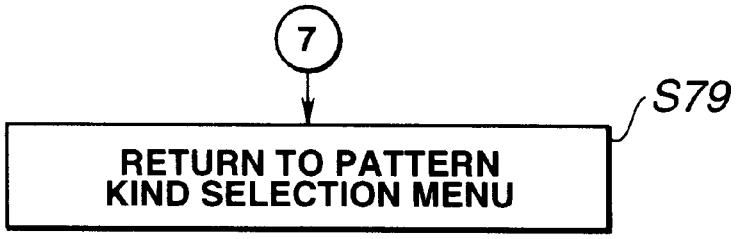
FIG. 28 is a flow chart showing a process (7) in the FIG. 23 flow chart.

In the FIG. 28 process, a step S79 is executed to return the current screen to the pattern select menu screen (FIG. 28).

If the "composition end" key 6 is not touched in the step S67 in FIG. 23, the program returns to the step S62. If it is touched in the same step, the program advances to a process of FIG. 29.

Figure 29:
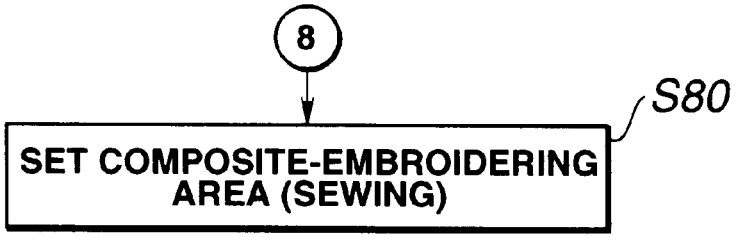
FIG. 29 is a flow chart showing a process (8) in the FIG. 23 flow chart.

In the FIG. 29 process based on the touching of the "composition end" key 6, a step S80 is executed to set the composite-embroidery area (sewing).

The process of FIG. 20 will be described again.

Following the composite-embroidery area setting (editing) process (step S6), a step S7 of a "pattern editing" (position, rotation, mirror) process is executed.

In the step S7, the "edit" key 2 is touched on the FIG. 2 screen to call the FIG. 16 screen. On this screen, an edit is carried out by properly using the "position/rotation" key 41, "size/inter-character" key 42, "smooth" key 43, "pattern designation" key 44, and "erasure" key 45.

On the FIG. 16 screen, if the "position/rotation" key 41 is touched, the current screen is changed to the FIG. 17 screen. For the pattern editing of this key, the operator operates the displayed keys on this screen; "position" key group 51 (arrow keys 51*u*, 51*d*, 51*l*, 51*r*, 51*ul*, 51*ur*, 51*dl*, and 51*dr*, and the center key 51*c*), and "turning direction" key pair 52 (5°-turn key 53*a*, 90°-turn key 53*b*).

The position and rotation angle of the pattern are set through the above key operations, and then the "change over" key 55 is touched to return the current screen to the original screen (FIG. 16).

When the editing process is completed, the "pattern combination" key 4 is touched to return the screen to the FIG. 2 screen.

Upon completion of the editing process, a step S8 is executed to judge if the "pattern combination" key 4 is touched. If it is touched, a step S9 is executed to if the "composition end" key 6 is touched. If it is touched, the program returns to the step S4.

If the "composition end" key 6 is not touched in the step S9, the program returns to the step S8. If it is touched, the program advances to the process of FIG. 21.

In the process of FIG. 21, a step S11 of the composite-embroidery area setting (sewing) process is executed (FIG. 19).

In the step S11, subroutines flow charted in FIGS. 30 to 36 are executed.

FIGS. 30 and 31 cooperate to show a flow chart of the subroutine of the composite-embroidery area setting (sewing) process (step S11). To execute the subroutine, a step S111 of the "embroidering-area setting screen" display process (FIG. 19) is executed. Then, a step S112 is executed to judge if any, some or all of the arrow keys 8*u*, 8*d*, 8*l* and 8*r* of the "window movement" key group 8 is touched.

If the answer is NO (any of the arrow keys is touched), a step S113 is executed to judge whether or not the "offset" key 13 is touched. If the answer is YES in the step S112, the program advances to a process of FIG. 32.

Figure 32:
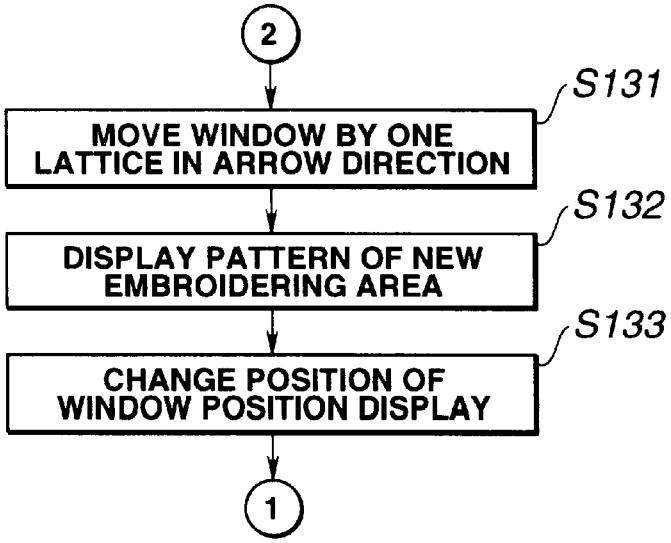
FIG. 32 is a flow chart showing a process (2) in the FIG. 30 flow chart.

In the FIG. 32 process based on the key touching, a step S311 is executed to move the window (=display window 1) in the arrow head direction of the arrow key by one unit block of the lattice (FIGS. 3, 4, 5, 6 and 7).

A step S132 is then executed to sequentially display the screens showing additional embroidery component patterns (FIGS. 3 through 7).

A step S133 is executed to change the position of the window position display. At this time, the reference position coordinates (X1, Y1), (X2, Y1), (X1, Y2), (X1, Y3), (X1, Y4), and so on with respect to the origin coordinates (Xo, Yo) are stored into a proper memory, e.g., RAM, and the program returns to the step S112 in the FIG. 30 subroutine.

In the FIG. 30 process, if the "offset" key 13 is not touched in the step S113, a step S114 is executed if the "edit" key 2 is touched. If the answer is YES (the key 13 is touched), the program proceeds to a process of FIG. 33.

Figure 33:
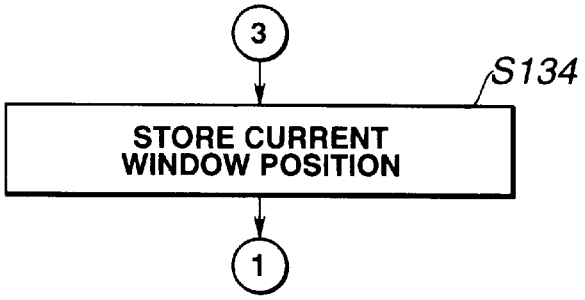
FIG. 33 is a flow chart showing a process (3) in the FIG. 30 flow chart.

In the FIG. 33 process, a step S134 is executed to store the present "window position", and upon touching of the "offset" key 13, the reference points coordinates (X1, Y1), (X2, Y1), (X1, Y2), (X1, Y3), (X1, Y4), and others are stored into the sewable-area frame position storing means formed by a part of the RAM. Then, the program returns to the step S112 in FIG. 30.

Therefore, also in the sewing process, as in the editing process, the display window 1, which will be displayed in the subsequent sewing process, will be positioned at the stored window positions.

If the "edit" key 2 is not touched in the step S114 (FIG. 30), a step S115 is executed to judge if the "composition end" key 6 is touched. If the "edit" key 2 is touched, the program advances to a process of FIG. 34.

Figure 34:
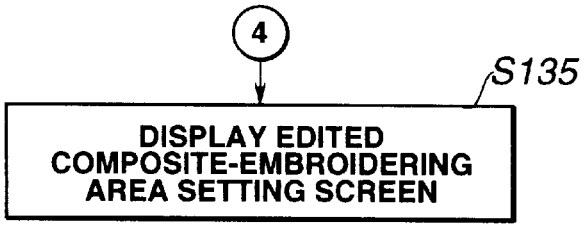
FIG. 34 is a flow chart showing a process (4) in the FIG. 30 flow chart.

In the FIG. 34 process based on the touching of the "edit" key 2, a step S135 is executed to display the "composite-embroidery area setting (editing)" screen.

If the "composition end" key 6 is not touched in the step S115 (FIG. 30), the program returns to the step S112. If it is touched, a step S116 is executed to display a "sewable area setting by the frame size" screen (FIG. 14).

Specifically, as shown in FIG. 14, a sewable area is set by use of the "embroidering-frame" display 11 by operating the arrow keys 61*u*, 61*d*, 61*l*, 61*r*, 61*ul*, 61*ur*, 61*dl*, and 61*dr* of the "frame movement" key group 61.

A step S117 is then executed to judge whether or not any, some or all of the arrow keys 6*u*, 61*d*, 61*l*, 61*r*, 61*ul*, 61*ur*, 61*dl*, and 61*dr* are operated. If any of those keys is not operated, a step S118 is executed to judge whether or not the "pattern designation" key 44 is operated. If any of those keys is operated, the program advances to a process of FIG. 35.

Figure 35:
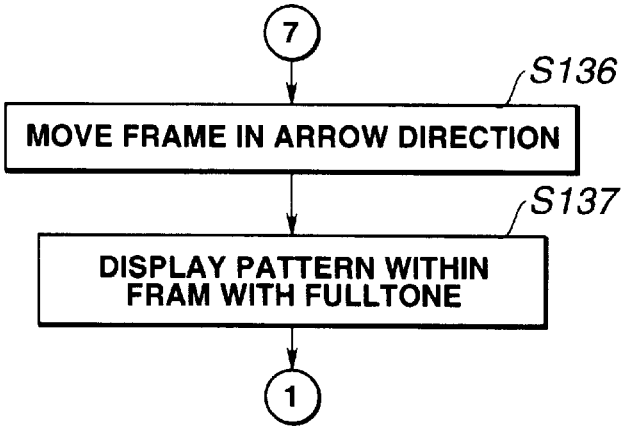
FIG. 35 is a flow chart showing a process (7) in the FIG. 30 flow chart.

In the FIG. 35 process based on the key operation, a step S136 is executed to move the "embroidering-frame" display 11 in the arrow head direction (FIGS. 8 through 11). Subsequently, a step S137 is executed to display a pattern within the "embroidering-frame" display 11 in full tone, and the program returns to the step S112.

If the "pattern designation" key 44 is not touched in the step S118 (FIG. 30), the program proceeds to a process of FIG. 31. If it is touched, the program goes to a process of FIG. 36.

Figure 36:
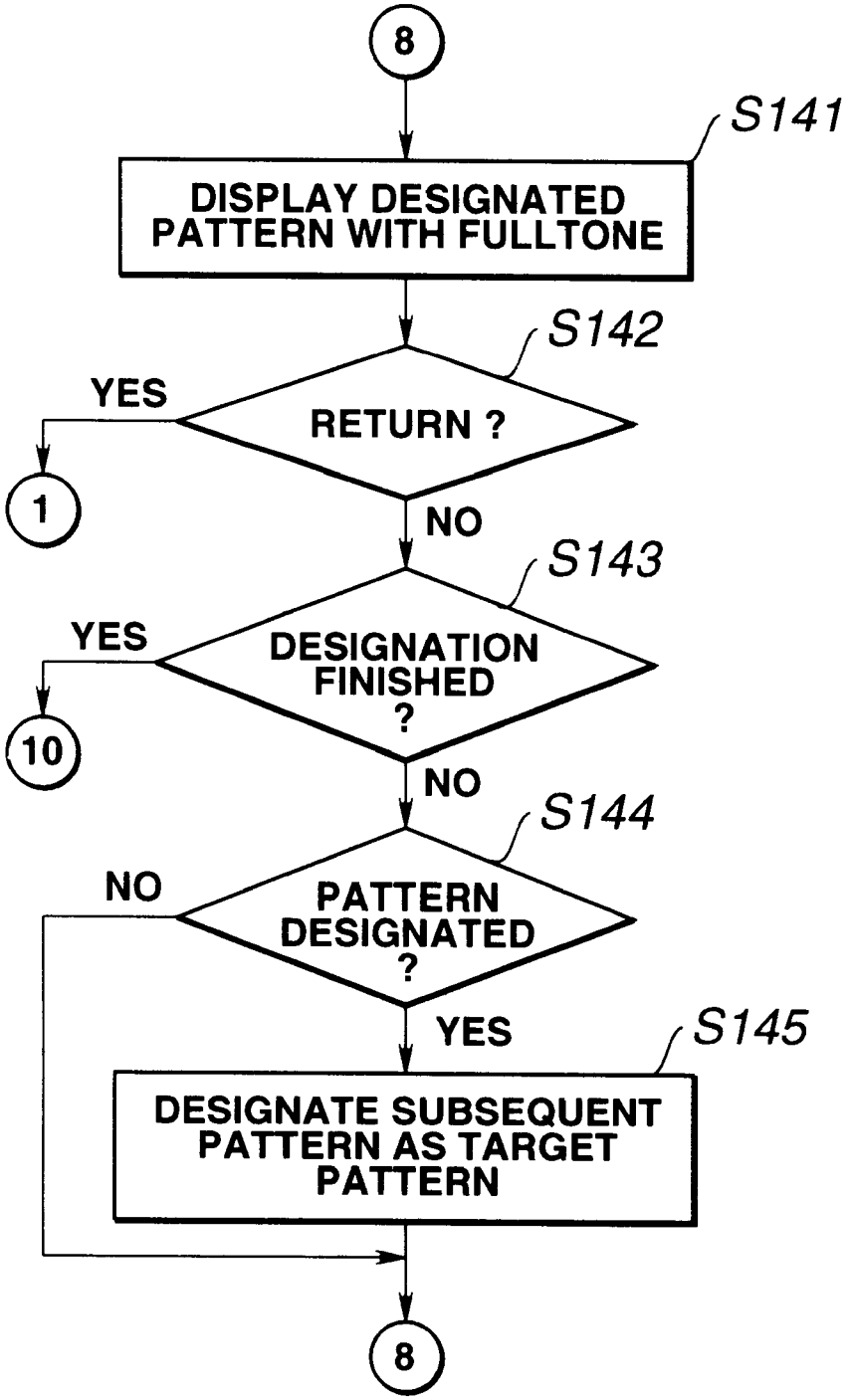
FIG. 36 is a flow chart showing a process (8) in the FIG. 30 flow chart.

In the process of FIG. 36, a step S141 is first executed to display a designated pattern in full tone, and a step S142 is executed to judge whether or not the "return" key 5 is operated.

If the "return" key 5 is not operated, a step S143 is executed to judge if the "designation end" key 63 is operated. If it is operated, the program returns to the step S112 (FIG. 30).

If the message display region 62 is not operated in the step S143, a step S144 is executed to check if the "pattern designation" key 44 is operated. If the answer is YES (the key is operated), the program advances to a step S123 in the process of FIG. 31.

The step S144 is executed again to check if the "pattern designation" key 44 is operated. If the answer is YES, the program goes to a step S145. If the answer is NO, the program returns to the step S141.

In the step S145 based on the operation of the "pattern designation" key 44, a process "to designate the next pattern as a target pattern" is carried out. Then, the program returns to the step S141.

In the process of FIG. 31, a step S121 is executed to determine if the "return" key 5 is operated. If the answer is NO (the key is not operated), the next step S122 is executed to determine if the "designation end" key 63 is operated. If the answer is YES, the program returns to the step 112 in FIG. 30.

If the answer is NO in the step S122, the program returns to the step S117 in FIG. 30. If the answer is YES, the next step S123 of a process "to display the positions of the frame and the reference lines and a message" is executed.

Specifically, the step S123 displays the positions of the "embroidering-frame" display 11 and the reference lines, and a message "Move the embroidery component pattern".

As already stated, before the sewing process, vertical and horizontal straight lines as reference lines are drawn in a lattice or matrix fashion on a work cloth on which embroidery component patterns are to be sewn. The positions of two points on the vertical lines and two points of the horizontal lines (on the display window 1) are stored by operating the touch keys and the position storing key, to thereby determine sewing positions.

Description is returned to the process of FIG. 21.

Following the process of "composite-embroidery area setting (sewing)" of the step S11, a process of "sewable area setting by the frame size" of a step S12 is executed (FIGS. 8, 9, 11, 12 and 13).

In the step S12, a sewable area is set by use of the "embroidering-frame" display 11 by operating the arrow keys 61*u*, 61*d*, 61*l*, 61*r*, 61*ul*, 61*ur*, 61*dl*, and 61*dr* of the "frame movement" key group 61 (FIGS. 8, 9, 11, 12, 13).

The next step S13 is executed; the sewing means of the embroidery sewing machine sews the "composite embroidery pattern" edited by the editing means.

A step S14 is executed to judge whether or not the sewing operation of the "composite embroidery pattern" on the display window 1, which is four times as large as the "embroidering-frame" display 11, is completed. If the sewing operation is not yet completed, the program returns to the step S12. If it is not yet completed, the next step S15 is executed to display a message "the stitching operation is completed".

Specifically, the message display regions 71 and 72 (FIG. 10) display the messages; "Sewing of all patterns is completed" and "return to the menu screen" message display 72.

In response to the operation of the "sew again" key 73, a step S16 is executed to judge whether or not the sewing of the entire composite embroidery area is completed. If the answer is NO, the program returns to the step S11. If the answer is YES, the subsequent step S17 is executed to judge if the "OK" key 74 is operated.

If the "OK" key 74 is not operated in the step S17, the program returns to the step S15. If it is operated, the program returns to the step S5.

Here, the editing process by the enlarging function of the "composite embroidery" and the sewing process having a continuing function based on the extended editing function are completed in their execution.

As described above, the embroidery sewing machine of the invention can sew a "composite embroidery" pattern onto a work cloth by drawing the reference lines onto a work cloth, and storing the position information of the drawn reference lines in a memory. More specifically, if reference lines are drawn while being equidistantly spaced and position information of the thus drawn reference lines are stored into a memory, the embroidery sewing machine can sew onto a work cloth a large "composite embroidery" pattern, e.g., an endless "composite embroidery" pattern, that a conventional home-use sewing machine cannot handle, under control of a CPU contained in the machine, which properly processes the position information.

In the above-mentioned embodiment, the edit area is four times as large as the area of the embroidering frame; however, it may be five times as large as the frame area or larger, if required.

Also in the embodiment, one reference point is used. If required, two or more larger number of reference points may be used. The number of reference lines may be limitless.

It should be understood that the arrangements of items displayed on the screens and the ways of processings, which are described and illustrated, may be modified and altered as occasion demands within the scope and spirits of the invention.

As seen from the foregoing description, the embroidery sewing machine of the invention can edit the embroidery component patterns while displaying a part of the composite embroidery pattern in an area larger than the display window by use of the editing means having the enlarging function.

Further, the embroidery sewing machine can sew the composite or target embroidery pattern thus edited, in the display area larger than the display window by use of the sewing means having a continuing function.

Therefore, the embroidery sewing machine can sew a large target or composite embroidery of endless pattern although it is of the home use type.

Moreover, the embroidery sewing machine has the following useful effect: in the editing process and the sewing process, the movement positions may be read out from the storing means, and be displayed on the display window.

What is claimed is:

1. An embroidery sewing machine in which an emboridery pattern is formed on a work cloth, said embroidery sewing machine comprising:

an embroidering frame for holding the work cloth;

a display window capable of displaying an embroidery pattern in an area larger than an area of said embroidering frame;

editing means for editorially composing a plural number of embroidery component patterns displayed on said display window as a composite embroidery pattern, said editing means having an enlarging function to edit the embroidery component patterns and to display a part of the composite embroidery pattern in an area larger than said display window in a manner that a preset point is set as a reference point on a display area of said display window and said reference point is horizontally and vertically moved; and sewing means for sewing said composite embroidery pattern onto the work cloth held by said embroidering frame, said sewing means having a continuing function to continue the sewing operation of the composite embroidery pattern that is edited in the area larger than that of said display window by use of said enlarging function of said editing means.

2. The embroidery sewing machine according to claim 1, wherein a sewable area frame corresponding to said embroidering frame is displayed on said display window, and a sewable-area frame position storing means is further provided which stores movement positions resulting from the movements of said reference points in said sewable area frame.

3. An embroidery sewing machine in which an embroidery pattern is formed on a work cloth, said embroidery sewing machine comprising:

a sewing machine body;

an embroidering frame having an embroidering area, for holding the work cloth;

display means provided with the sewing machine body, for displaying an embroidery pattern in a display area larger than the embroidering frame;

arranging means provided with the sewing machine body, for selecting the embroidery pattern, and for arranging the selected embroidery pattern within the display area of said display means;

editing means for combining patterns displayed within the display area of said display means, for editing pattern stitching data of positions with respect to an original point and pattern kinds, and for storing the pattern stitching data;

a sewing device forming pattern stitches on the work cloth held by said embroidering frame while said sewing device moves said embroidering frame based on single pattern stitching data;

means for designating a mode of editing pattern stitching data for a pattern being larger than the display area of said display means; and means for shifting the display area of said display means at least in vertical directions, wherein said shifting means is operative by said mode designating means; and renewal means for, when the embroidery patterns are arranged in accordance with the display area shifted by said shifting means, editing pattern stitching data of positions and pattern kinds with respect to the original point within the display area firstly displayed, and for storing the pattern stitching data.

* * * * *